US009027287B2

(12) United States Patent
Trevithick et al.

(10) Patent No.: US 9,027,287 B2
(45) Date of Patent: May 12, 2015

(54) FAST TRANSPORTABLE DRILLING RIG SYSTEM

(75) Inventors: Mark W. Trevithick, Houston, TX (US); Darrell E. Jamison, Humble, TX (US); Gus E. Rodriguez, Spring, TX (US); Keith J. Orgeron, Spring, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 0 days.

(21) Appl. No.: 13/335,749

(22) Filed: Dec. 22, 2011

(65) Prior Publication Data

US 2012/0167485 A1 Jul. 5, 2012

Related U.S. Application Data

(60) Provisional application No. 61/428,778, filed on Dec. 30, 2010.

(51) Int. Cl.

| | |
|---|---|
| ***E21B 15/00*** | (2006.01) |
| ***E04H 12/18*** | (2006.01) |
| ***E04H 12/34*** | (2006.01) |

(52) U.S. Cl.

CPC ..... *E21B 15/00* (2013.01); *E04H 12/187* (2013.01); *E04H 12/345* (2013.01)

(58) Field of Classification Search

CPC ..... E21B 15/00; E21B 15/003; E21B 7/02; E21B 7/023; E04H 12/18; E04H 12/187; E04H 12/182; E04H 12/344; E04H 12/345; B66F 9/08; B66F 9/082

USPC ..... 52/111, 116, 119, 120; 175/52, 162, 85, 175/203; 414/22.55, 814, 815

See application file for complete search history.

(56) References Cited

U.S. PATENT DOCUMENTS

| | | | |
|---|---|---|---|
| 184,168 | A | 11/1876 | Nickle |
| 1,369,165 | A | 2/1921 | Cochran et al. |
| 1,417,490 | A | 5/1922 | Brandon |
| 1,972,635 | A | 9/1934 | Whinnen |
| 2,327,461 | A | 8/1943 | Rowe |
| 2,369,534 | A | 2/1945 | Cohen |
| 2,382,767 | A | 8/1945 | Zeilman |
| 2,476,210 | A | 7/1949 | Moore |
| 2,595,307 | A | 5/1952 | Seibert |

(Continued)

FOREIGN PATENT DOCUMENTS

| | | | |
|---|---|---|---|
| EP | 1752608 | A2 | 2/2007 |
| GB | 727780 | A | 4/1955 |

*Primary Examiner* — Jessica Laux

(74) *Attorney, Agent, or Firm* — John G. Fischer, Esq.; Scheef & Stone, L.L.P.

(57) ABSTRACT

The present invention discloses a high-capacity drilling rig system that includes novel design features that alone and more particularly in combination facilitate a fast rig-up and rig-down with a single set of raising cylinders and maintains transportability features. In particular, a transport trailer is disclosed having a first support member and a drive member which align the lower mast portion with inclined rig floor ramps and translate the lower mast legs up the ramps and into alignment for connection. A pair of wing brackets is pivotally deployed from within the lower mast width for connection to the raising cylinder for raising the mast from a horizontal position into a vertical position. A cantilever is pivotally deployed from beneath the rig floor to a position above it for connection to the raising cylinder for raising the substructure from a collapsed position into the erect position.

9 Claims, 19 Drawing Sheets

(56) References Cited

U.S. PATENT DOCUMENTS

| | | | | |
|---|---|---|---|---|
| 2,715,014 | A | 8/1955 | Garnett et al. | |
| 2,814,396 | A | 11/1957 | Neal, Sr. | |
| 2,840,244 | A | 6/1958 | Thomas, Jr. | |
| 3,016,992 | A | 1/1962 | Wilson | |
| 3,076,500 | A | 2/1963 | Bushong et al. | |
| 3,076,560 | A | 2/1963 | Bushong et al. | |
| 3,136,394 | A | 6/1964 | Woolslayer et al. | |
| 3,177,944 | A | 4/1965 | Knights | |
| 3,180,496 | A | 4/1965 | Smith | |
| 3,280,920 | A | 10/1966 | Scott | |
| 3,464,507 | A | 9/1969 | Alexander et al. | |
| 3,477,522 | A | 11/1969 | Templeton | |
| 3,559,821 | A | 2/1971 | James | |
| 3,774,781 | A | 11/1973 | Merkley | |
| 3,797,672 | A | 3/1974 | Vermette | |
| 3,804,264 | A | 4/1974 | Hedeen et al. | |
| 3,805,463 | A | 4/1974 | Lang et al. | |
| 3,860,122 | A | 1/1975 | Cernosek | |
| 3,942,593 | A | 3/1976 | Reeve, Jr. et al. | |
| 3,991,887 | A | 11/1976 | Trout | |
| 3,995,746 | A | 12/1976 | Usagida | |
| 4,044,952 | A | 8/1977 | Williams et al. | |
| 4,135,340 | A | 1/1979 | Cox et al. | |
| 4,138,805 | A | 2/1979 | Patterson | |
| 4,201,022 | A | 5/1980 | Jennings | |
| 4,269,009 | A * | 5/1981 | Lawrence | 52/116 |
| 4,290,495 | A | 9/1981 | Elliston | |
| 4,386,883 | A | 6/1983 | Hogan et al. | |
| 4,407,629 | A | 10/1983 | Willis | |
| 4,426,182 | A | 1/1984 | Frias et al. | |
| 4,492,501 | A | 1/1985 | Haney | |
| 4,529,094 | A | 7/1985 | Wadsworth | |
| 4,547,110 | A | 10/1985 | Davidson | |
| 4,595,066 | A | 6/1986 | Nelmark et al. | |
| 4,598,509 | A | 7/1986 | Woolslayer et al. | |
| 4,759,414 | A | 7/1988 | Willis | |
| 4,767,100 | A | 8/1988 | Philpot | |
| 4,821,816 | A | 4/1989 | Willis | |
| 4,822,230 | A | 4/1989 | Slettedal | |
| 4,834,604 | A | 5/1989 | Brittain et al. | |
| 4,837,992 | A | 6/1989 | Hashimoto | |
| 4,982,853 | A | 1/1991 | Kishi | |
| 5,458,454 | A | 10/1995 | Sorokan | |
| 5,609,260 | A | 3/1997 | Liao | |
| 5,931,238 | A | 8/1999 | Gilmore et al. | |
| 5,964,550 | A | 10/1999 | Blandford et al. | |
| 5,988,299 | A | 11/1999 | Hansen et al. | |
| 5,993,140 | A | 11/1999 | Crippa | |
| 6,003,598 | A | 12/1999 | Andreychuk | |
| 6,045,297 | A | 4/2000 | Voorhees et al. | |
| 6,079,490 | A | 6/2000 | Newman | |
| 6,079,925 | A | 6/2000 | Morgan et al. | |
| 6,220,807 | B1 | 4/2001 | Sorokan | |
| 6,298,928 | B1 | 10/2001 | Penchansky | |
| 6,343,892 | B1 | 2/2002 | Kristiansen | |
| 6,431,286 | B1 | 8/2002 | Andreychuk | |
| 6,524,049 | B1 | 2/2003 | Minnes | |
| 6,533,045 | B1 | 3/2003 | Cooper | |
| 6,581,698 | B1 | 6/2003 | Dirks | |
| 6,609,573 | B1 | 8/2003 | Day | |
| 6,705,414 | B2 | 3/2004 | Simpson et al. | |
| 6,779,614 | B2 | 8/2004 | Oser | |
| 6,854,520 | B1 | 2/2005 | Robichaux | |
| 7,077,209 | B2 | 7/2006 | McCulloch et al. | |
| 7,306,055 | B2 * | 12/2007 | Barnes | 175/57 |
| 7,513,312 | B2 | 4/2009 | Carriere et al. | |
| 7,726,929 | B1 | 6/2010 | Orgeron | |
| 7,918,636 | B1 | 4/2011 | Orgeron | |
| 8,172,497 | B2 | 5/2012 | Orgeron et al. | |
| 8,250,816 | B2 * | 8/2012 | Donnally et al. | 52/123.1 |
| 2002/0070187 | A1 | 6/2002 | Willim | |
| 2003/0172599 | A1 * | 9/2003 | Frink | 52/116 |
| 2004/0040926 | A1 | 3/2004 | Irsch et al. | |
| 2004/0211598 | A1 | 10/2004 | Palidis | |
| 2005/0193645 | A1 | 9/2005 | Barnes | |
| 2005/0269133 | A1 | 12/2005 | Little | |
| 2007/0074460 | A1 | 4/2007 | Belik | |
| 2008/0202812 | A1 | 8/2008 | Childers et al. | |
| 2008/0253866 | A1 | 10/2008 | Lops et al. | |
| 2009/0071720 | A1 | 3/2009 | Cowan | |
| 2009/0218144 | A1 | 9/2009 | Donnally et al. | |
| 2011/0200412 | A1 | 8/2011 | Orgeron | |

* cited by examiner

FAST TRANSPORTABLE DRILLING RIG SYSTEM

TECHNICAL FIELD OF INVENTION

The present invention relates to a new rig mast, substructure, and transport trailer for use in subterranean exploration. The present invention provides rapid rig-up, rig-down and transport of a full-size drilling rig. In particular, the invention relates to a self-erecting drilling rig in which rig-up of the mast and substructure may be performed without the assistance of a crane. The rig components transport without removal of the drilling equipment including top drive with mud hose and electrical service loop, AC drawworks, rotary table, torque wrench, standpipe manifold, and blow out preventers (BOP), thus reducing rig-up time and equipment handling damage.

BACKGROUND OF THE INVENTION

In the exploration of oil, gas and geothermal energy, drilling operations are used to create boreholes, or wells, in the earth. Drilling rigs used in subterranean exploration must be transported to the locations where drilling activity is to be commenced. These locations are often remotely located. The transportation of such rigs on state highways requires compliance with highway safety laws and clearance underneath bridges or inside tunnels. This requirement results in extensive disassembly of full-size drilling rigs to maintain a maximum transportable width and transportable height (mast depth) with further restrictions on maximum weight, number and spacing of axles, and overall load length and turning radius. These transportation constraints vary from state to state, as well as with terrain limitations. These constraints can limit the size and capacity of rigs that can be transported and used, conflicting with the subterranean requirements to drill deeper, or longer reach horizontal wells, more quickly, requiring larger rigs.

Larger, higher capacity drilling rigs are needed for deeper (or horizontally longer) drilling operations, since the hook load for deeper operations is very high, requiring rigs to have a capacity of 500,000 lbs. and higher. Constructing longer, deeper wells requires increased torque, mud pump capacity and the use of larger diameter tubulars in longer strings. Larger equipment is required to handle these larger tubulars and longer strings. All of these considerations drive the demand for larger rigs. Larger rigs require a wider base structure for strength and wind stability, and this requirement conflicts with the transportability constraint and the time and cost of moving them. Larger rigs also require higher drill floors to accommodate taller BOP stacks. Once transported to the desired location, the large rig components must each be moved from a transport trailer into engagement with the other components located on the drilling pad. Moving a full-size rig and erecting a conventional mast and substructure generally requires the assistance of large cranes at the drilling site. The cranes will be required again when the exploration activity is complete and it is time to take the rig down and prepare it for transportation to a new drilling site.

Once the cranes have erected the mast and substructure, it is necessary to reinstall much of the machinery associated with the operation of the drilling rig. Such machinery includes, for example, the top drive with mud hose and electrical service loop, AC drawworks, rotary table, torque wrench, standpipe manifold, and BOP.

Rigs have been developed with mast raising hydraulic cylinders and with secondary substructure raising cylinders for erection of the drilling rig without the use, or with minimal use, of cranes. For example, boost cylinders have been used to fully or partially raise the substructure in combination with mast raising cylinders. These rigs have reduced rig transport and rig-up time; however, substructure hydraulics are still required and the three-step lifting process and lower mast lifting capacity remain compromised in these configurations. Also, these designs incorporate secondary lifting structures, such as mast starter legs which are separated completely from the mast for transportation. These add to rig-up and rig-down time, weight, and transportation requirements, encumber rig floor access, and may still require cranes for rig-up. Importantly, the total weight is a critical concern.

Movement of rig masts from transport trailers to engagement with substructures remains time consuming and difficult. Also, rig lifting supports create a wider mast profile, which limits the size of the structure support itself due to transportation regulations, and thus the wind load limit of the drilling rig. In particular, it is very advantageous to provide substructures having a height of less than 8 (eight) feet to minimize the incline and difficulty of moving the mast from its transport position into its connectable position on top of the collapsed substructure. However, limiting the height of the collapsed substructure restricts the overall length of retracted raising cylinders in conventional systems. It further increases the lift capacity requirement of the raising cylinder due to the disadvantageous angle created by the short distance from ground to drilling floor in the collapsed position.

For the purpose of optimizing the economics of the drilling operation, it is highly desirable to maximize the structural load capacity of the drilling rig and wind resistance without compromising the transportability of the rig, including, in particular, the width of the lower mast section, which bears the greatest load.

Assembly of drilling rigs for different depth ratings results in drilling rig designs that have different heights. Conventional systems often require the use of different raising cylinders that are incorporated in systems that are modified to accommodate the different capacity and extension requirements that are associated with drilling rigs having different heights from ground to drill floor. This increases design and construction costs, as well as the problems associated with maintaining inventories of the expensive raising cylinders in multiple sizes.

It is also highly desirable to devise a method for removing an equipment-laden lower mast section from a transport trailer into engagement with a substructure without the use of supplemental cranes. It is also desirable to minimize accessory hydraulics, and the size and number of telescopic hydraulic cylinders required for rig erection. It is also desirable to minimize accessory structure and equipment, particularly structure and equipment that may interfere with transportation or with manpower movement and access to the rig floor during drilling operations. It is also desirable to ergonomically limit the manpower interactions with rig components during rig-up for cost, safety and convenience.

It is also highly desirable to transport a drilling rig without unnecessary removal of any more drilling equipment than necessary, such as the top drive with mud hose and electrical service loop, AC drawworks, rotary table, torque wrench, standpipe manifold, and BOP. It is highly desirable to transport a drilling rig without removing the drill line normally reeved between the travelling block and the crown block. It is also highly desirable to remove the mast from the transport trailer in alignment with the substructure, and without the use of cranes. It is also desirable to maintain a low height of the collapsed substructure. It is also desirable to have a system that can adapt a single set of raising cylinders for use on substructures having different heights.

Technological and economic barriers have prevented the development of a drilling rig capable of achieving these goals. Conventional prior art drilling rig configurations remain manpower and equipment intensive to transport and rig-up. Alternative designs have failed to meet the economic and reliability requirements necessary to achieve commercial application. In particular, in deeper drilling environments, high-capacity drilling rigs are needed, such as rigs having hook loads in excess of 500,000 lbs., and with rated wind speeds in excess of 100 mph. Quick rig-down and transportation of these rigs have proven to be particularly difficult. Highway transport regulations limit the width and height of the transported mast sections as well as restricting the weight. In many states, the present width and height limit is 14 feet by 14 feet. Larger loads are subject to additional regulations including the requirement of an escort vehicle.

In summary, the preferred embodiments of the present invention provide unique solutions to many of the problems arising from a series of overlapping design constraints, including transportation limitations, rig-up limitations, hydraulic raising cylinder optimization, craneless rig-up and rig-down, and static hook load and rated wind speed requirements.

SUMMARY OF THE INVENTION

The present invention provides a substantially improved drilling rig system. In one embodiment, a drilling mast transport skid is provided comprising a frame positionable on a transport trailer. A forward hydraulically actuated slider, and a rear hydraulically actuated slider are located on the frame. The sliders are movable in perpendicular relationship to the frame. An elevator is movably located between the rear slider and the mast supports (or equivalently between the rear slider and frame) for vertically elevating the mast relative to the frame. A carriage is movably located between the frame and the forward slider for translating the forward slider along the length of the frame. A mast section of a drilling rig may be positioned on the sliders, such that controlled movement of the sliders, the elevator and the carriage can be used to position the mast section for connection to another structure.

In another embodiment, a slide pad is located on an upper surface of at least one of the sliders, so as to permit relative movement between the mast section and the slider when articulating the slider.

In another embodiment, an elevator is located on each side of the rearward slider, between the rearward slider and the mast support, such that each elevator is independently movable between a raised and lowered position for precise axial positioning of the mast section.

In another embodiment, a roller set between the carriage and the frame provides a rolling relationship between the carriage and the frame. A motor is connected to the carriage. A pinion gear is connected to the motor. A rack gear is mounted lengthwise on the frame, and engages the pinion gear, such that operation of the motor causes movement of the forward slider lengthwise along the frame.

In one embodiment, a drilling rig is provided, comprising a collapsible substructure including a base box, a drill floor and a pair of raising cylinders pivotally connected at one end to the base box and having an opposite articulating end. The raising cylinders are selectively extendable relative to their pivotal connection at the base box. A mast is provided, and has a lower mast section comprising a framework having a plurality of cross-members that define a transportable width of the lower mast section. The lower mast section has a plurality of legs, having an upper end attached to the framework, and an opposite lower end. A connection on the lower end of at least two legs is provided for pivotally connecting the lower mast section to the drill floor.

A pair of wing brackets is deployably secured to the lower mast section framework. The wing brackets are pivotal or slidable between a stowed position within the transport width of the lower mast section and a deployed position that extends beyond the transport width of the lower mast section. The raising cylinder is connectable to the wing brackets and extendable to rotate the lower mast section from a generally horizontal position to a raised position above the drill floor to a substantially vertical position above the drill floor, or to a desired angle that is less than vertical.

In another embodiment, each wing bracket of the drilling rig further comprises a frame having a pair of frame sockets on its opposite ends. The frame sockets pivotally connect the frame to the lower mast section. The wing brackets pivot to fit substantially within a portal in the lower mast section in the stowed position.

In another embodiment, the pivotal connection of the frame to the mast defines a pivot axis of the wing bracket about which the wing bracket is deployed and stowed. The pivotal connection between the lower mast section legs and the drill floor defines a pivot axis of the mast. In a preferred embodiment, the pivot axis of the wing bracket is substantially perpendicular to the pivot axis of the mast.

In another embodiment, each wing bracket of the drilling rig further comprises a frame and an arm extending from the frame towards the interior of the lower mast section. An arm socket is located on the end of the arm opposite to the frame. A bracket locking pin is attached to the lower mast section and is extendable through the arm socket to lock the wing bracket in the deployed position.

In another embodiment, each wing bracket of the drilling rig further comprises a frame and a lug box attached to the frame. The lug box is receivable of the articulating end of the raising cylinder. A lug socket is located on the lug box. A raising cylinder lock pin is extendable through the articulating end of the raising cylinder and the lug socket to lock the raising cylinder in pivotal engagement with the wing bracket.

In another embodiment, each wing bracket of the drilling rig further comprises a wing cylinder attached between the interior of the lower mast section and the arm of the wing bracket. Actuation of the wing cylinder moves the wing bracket between the deployed and stowed positions, without the need to have workers scaling the mast to lock the wing in position.

In one embodiment, a drilling rig assembly is provided comprising a collapsible substructure that is movable between the stowed and deployed positions. The collapsible substructure includes a base box, a drill floor framework and a drill floor above the drill floor framework, and a plurality of legs having ends pivotally connected between the base box and the drill floor. The legs support the drill floor above the base box in the deployed position. A raising cylinder has a lower end pivotally connected at one end to the base box and an opposite articulating end. The raising cylinder is selectively extendable relative to the pivotal connection at the base box. A cantilever is provided, having a lower end and an upper end, and being pivotally connected to the drill floor framework, the upper end movable between a stowed position below the drill floor and a deployed position above the drill floor. The upper end of the cantilever is connectable to the articulating end of the raising cylinder when the cantilever is in the deployed position, such that extension of the raising cylinder raises the substructure into the deployed position.

In one embodiment, the raising cylinder can be selectively connected to a lower mast section of a drilling mast that is pivotally connected above the drill floor such that extension of the raising cylinder raises the lower mast section from a generally horizontal position to a generally vertical position above the drill floor. In another embodiment, the raising cylinder raises the lower mast section from a generally horizontal position to a position above the drill floor that is within 50 degrees of vertical to permit slant drilling operations.

In another embodiment, a cantilever cylinder is pivotally connected at one end to the drill floor framework and has an opposite end pivotally connected to the cantilever. The cantilever cylinder is selectively extendable relative to its pivotal connection at the drill floor framework. Extension of the cantilever cylinder rotates the cantilever from the stowed position below the drill floor to the deployed position above the drill floor. Retraction of the cantilever cylinder retracts the cantilever from the deployed position above the drill floor to the stowed position below the drill floor.

In another embodiment, the substructure includes a box beam extended horizontally beneath the drill floor and a beam brace affixed to the box beam. The cantilever engages the beam brace upon rotation of the cantilever into the fully deployed position. Extension of the raising cylinder transfers the lifting force for deployment of the substructure to the box beam through the cantilever and beam brace.

In another embodiment, when the substructure is in the collapsed position and the raise cylinder is connected to the cantilever, the centerline of the raise cylinder forms an angle to the centerline of a substructure leg that is greater than 20 degrees. In another embodiment, when the substructure is in the collapsed position, the distance from the ground to the drill floor is less than 8 feet.

In another embodiment, connection of the upper end of the cantilever to the articulating end of the raising cylinder forms an angle between the cantilever and the raising cylinder of between 70 and 100 degrees, and extension of the raising cylinder to deploy the substructure reduces the angle between the cantilever and the raising cylinder to between 35 and 5 degrees.

In another embodiment, an opening is provided in the drill floor that is sufficiently large so as to permit passage of the cantilever as it moves between the stowed and deployed positions. A backer panel is attached to the cantilever and is sized for complementary fit into the opening of the drill floor when the cantilever is in the stowed position.

In another embodiment, the mast has front legs and rear legs. The front legs are connectable to front leg shoes located on the drill floor. The rear legs are connectable to rear leg shoes located on the drill floor. In another embodiment, the lower end of the raising cylinder is pivotally connected to the base box at a location beneath and between the front leg shoes and the rear leg shoes of the drill floor of the erected substructure. The lower end of the cantilever is pivotally connected to the drill floor framework at a location beneath the drill floor.

In one embodiment, a drilling rig assembly is provided, comprising a collapsible substructure movable between the stowed and deployed positions. The collapsible substructure includes a base box and a drill floor framework having a drill floor above the drill floor framework. The substructure further includes a plurality of legs having ends pivotally connected to the base box and drill floor framework, such that the legs support the drill floor above the base box in the deployed position of the substructure. A mast is included, having a lower mast section pivotally connected above the drill floor and movable between a generally horizontal position to a position above the drill floor.

A cantilever has a lower end and an upper end, the lower end being pivotally connected to the drill floor framework. The upper end is movable between a stowed position below the drill floor and a deployed position above the drill floor. A raising cylinder is pivotally connected at one end to the base box and has an opposite articulating end. The raising cylinder is selectively extendable relative to the pivotal connection at the base box. The articulating end of the raising cylinder is connectable to the mast such that extension of the raising cylinder moves the mast from a generally horizontal position above the drill floor to a generally vertical position above the drill floor. The articulating end of the raising cylinder is also connectable to the upper end of the cantilever such that extension of the raising cylinder raises the drilling substructure into the deployed position.

In another embodiment, the raising cylinder can be selectively connected to a lower mast section of a drilling mast that is pivotally connected above the drill floor such that extension of the raising cylinder raises the lower mast section from a generally horizontal position to a generally vertical position above the drill floor. In another embodiment, the partial extension of the raising cylinder is selectable for raising the mast to an angular position of at least 50 degrees of the vertical for slant drilling operations.

In another embodiment, a pair of wing brackets is pivotally attached to the lower mast section and capable of attachment to the raising cylinder. The raising cylinder may be connected to the wing brackets and extended to rotate the lower mast section from a generally horizontal position to a generally vertical position above the drill floor. In another embodiment, the partial extension of the raising cylinder is selectable for raising the mast to an angular position of at least 50 degrees of the vertical for slant drilling operations.

In another embodiment, the wing brackets are pivotal between a deployed position and a stowed position. A lug socket is located on each bracket and is connectable to the raising cylinder. In the stowed position, the wing brackets are contained within the width of the lower mast section. In the deployed position, the wing brackets extend beyond the width of the lower mast such that the sockets are in alignment with the articulating end of the raising cylinder.

In one embodiment, a drilling rig assembly is provided comprising a raising cylinder. The raising cylinder has a first angular position for connection to a deployable wing bracket connected to a mast section. The raising cylinder has a second angular position for detachment from the deployable wing bracket at the conclusion of raising a mast into the vertical position. The raising cylinder has a third angular position for connection to a retractable cantilever connected to a substructure in a stowed (collapsed) position. The raising cylinder has a fourth angular position for detachment of the raising cylinder from the retractable cantilever at the conclusion of raising a subsection into the deployed (vertical) position. In a preferred embodiment, the first angular position is located within 10 degrees of the fourth angular position, and the second angular position is located within 10 degrees of the third angular position.

In another embodiment, the raising cylinder has a pivotally connected end about which it rotates and an articulating end for connection to the deployable wing bracket and the retractable cantilever. The articulating end of the raising cylinder forms a first lifting arc between the first angular position and the second angular position. The articulating end of the raising cylinder forms a second lifting arc between the first angular position and the second angular position. The first and second lifting arcs intersect substantially above the pivotally connected end of the raising cylinder.

In another embodiment, the raising cylinder rotates in a first rotational direction while raising the mast sections. The raising cylinder rotates in a second rotational direction opposite to the first rotational direction while raising the substructure.

In another embodiment, the raising cylinder is a multistage cylinder having a maximum of three stages. In another embodiment, the wing brackets are deployed about a first pivot axis. The cantilevers are deployed about a second pivot axis that is substantially perpendicular to the first pivot axis.

In one embodiment, a drilling rig assembly is provided comprising a collapsible substructure movable between the stowed and deployed positions. The collapsible substructure includes a base box and a drill floor framework with a drill floor above the drill floor framework. A plurality of substructure legs have ends pivotally connected to the base box and the drill floor for supporting the drill floor above the base box in the deployed position.

A lower mast section of a drilling mast is provided comprising a lower section framework having a plurality of cross-members that define a transportable width of the lower mast section. A plurality of legs is pivotally connected to the lower section framework for movement between a stowed position and a deployed position. A connection is provided on the lower end of at least two legs for pivotally connecting the lower mast section above the drill floor.

A raising cylinder is pivotally connected at one end to the base box and has an opposite articulating end. The raising cylinder is selectively extendable relative to the pivotal connection at the base box. A wing bracket is pivotally connected to the lower mast section of a drilling mast and movable between a stowed position and a deployed position. The wing bracket is connectable to the articulating end of the raising cylinder when the cantilever is in the deployed position, such that extension of the raising cylinder raises the lower mast section into a generally vertical position above the drill floor.

In another embodiment, the legs are movable between a stowed position within the transport width and a deployed position external of the transport width. The wing brackets are also movable between a stowed position within the transport width and a deployed position external of the transport width.

In another embodiment, the legs are pivotally movable about a first axis. The wing brackets are pivotally movable about a second axis that is substantially perpendicular to the first axis.

In another embodiment, a cantilever is pivotally connected to the drill floor and is movable between a stowed position below the drill floor and a deployed position above the drill floor. The cantilever is connectable to the articulating end of the raising cylinder when the cantilever is in the deployed position, such that extension of the raising cylinder raises the drill floor into the deployed position.

In another embodiment, the cantilever is deployed about a third pivot axis substantially perpendicular to each of the first pivot axis and the second pivot axis.

In one embodiment, a method of assembling a drilling rig provides for steps comprising: setting a collapsible substructure onto a drilling site; moving a lower mast section into proximity with the substructure; pivotally attaching the lower mast section to a drill floor of the substructure; pivotally deploying a pair of wings outward from a stowed position within the lower mast section to a deployed position external of the lower mast section; connecting an articulating end of a raising cylinder having an opposite lower end to the substructure to each wing; extending the raising cylinder so as to rotate the lower mast section from a substantially horizontal position to an erect position above the drill floor; pivotally deploying a pair of cantilevers upward from a stowed position beneath the drill floor to a deployed position above the drill floor; connecting the articulating end of the raising cylinder to each deployed cantilever; and extending the raising cylinder so as to lift the substructure from a stowed, collapsed position to a deployed, erect position.

In another embodiment, the raising cylinders are adjusted as a central mast section and an upper mast section are sequentially attached to the lower mast section.

As will be understood by one of ordinary skill in the art, the sequence of the steps disclosed may be modified and the same advantageous result obtained. For example, the wings may be deployed before connecting the lower mast section to the drill floor (or drill floor framework).

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
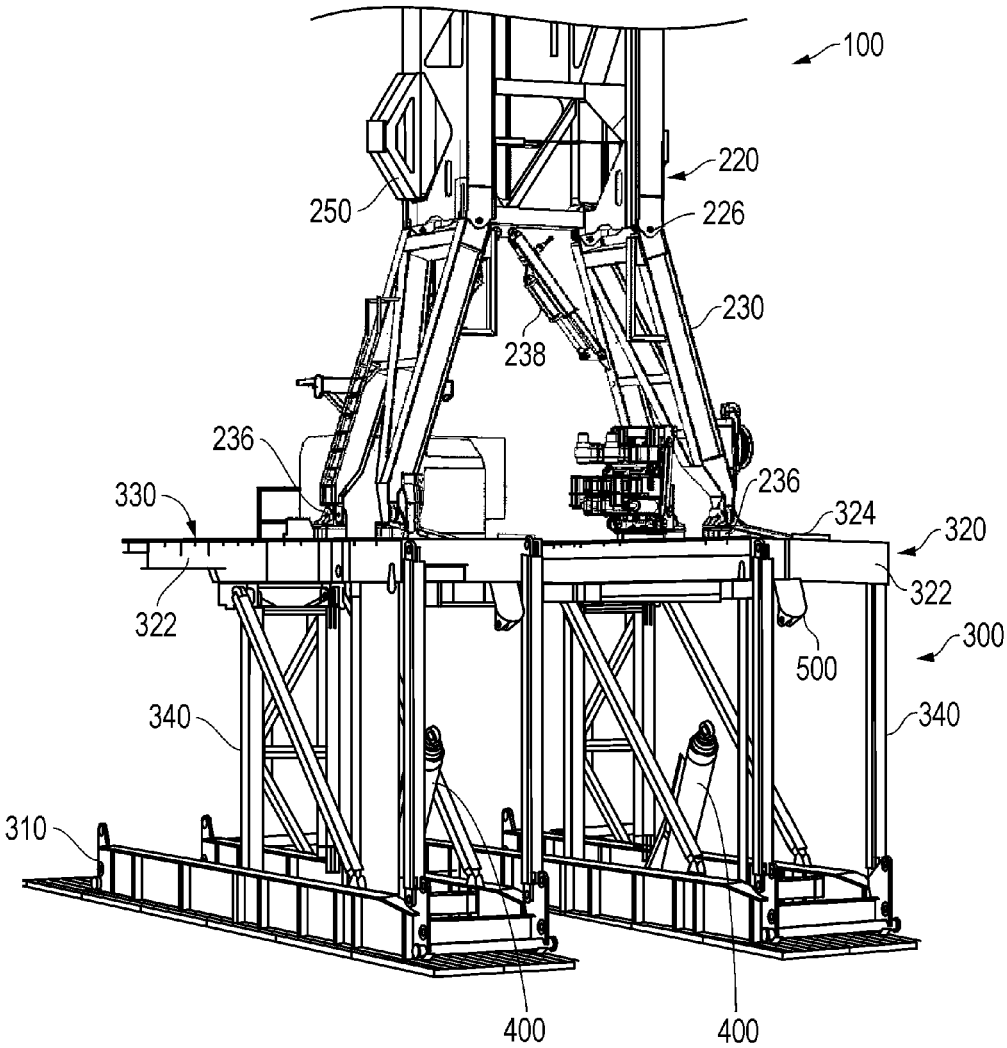
FIG. 1 is an isometric view of a drilling system having certain features in accordance with the present invention.

FIG. 1 is an isometric view of a drilling rig assembly 100 including features of the invention. As seen in FIG. 1, drilling assembly 100 has a lower mast section 220 mounted on top of a substructure 300.

Mast leg pairs 230 are pivotally attached to lower mast section 220 at pivot connections 226. Mast leg cylinders 238 may be connected between lower mast section 220 and mast legs 230 for moving mast legs 230 between a transportable stowed position and the illustrated deployed position. The wider configuration of deployed mast legs 230 provides greater drilling mast wind resistance and more space on a drilling floor for conducting drilling operations.

A pair of wing brackets 250 is pivotally connected to lower mast section 220 immediately above pivot connections 226. Wing brackets 250 are movable between a transportable stowed position and the illustrated deployed position.

Collapsible substructure 300 supports mast sections 200, 210 (not shown) and 220. Substructure 300 includes a base box 310 located at ground level. A drill floor framework 320 is typically comprised of a pair of side boxes 322 and a center section 324. A plurality of substructure legs 340 is pivotally connected between drill floor framework 320 and the base box 310. A box beam 326 (not visible) spans side boxes 322 of drill floor framework 320 for structural support. A drill floor 330 covers the upper surface of drill floor framework 320.

A pair of cantilevers 500 is pivotally attached to drill floor framework 320. Cantilevers 500 are movable between a transportable stowed position and a deployed position. In the stowed position, cantilevers 500 are located beneath drill floor 330. In the deployed position, cantilevers 500 are raised above drill floor 330.

A pair of raising cylinders 400 is provided for raising connected mast sections 200, 210 and 220 into the vertical position above substructure 300, and also for raising substructure 300 from a transportable collapsed position to the illustrated deployed position. Raising cylinders 400 are also provided for lowering substructure 300 from the illustrated deployed position to a transportable collapsed position, and for lowering connected mast sections 200, 210 and 220 into the horizontal position above collapsed substructure 300.

Raising cylinders 400 raise and lower connected mast sections 200, 210 and 220 by connection to wing brackets 250. Raising cylinders 400 raise and lower substructure 300 by connection to cantilevers 500.

Figure 2:
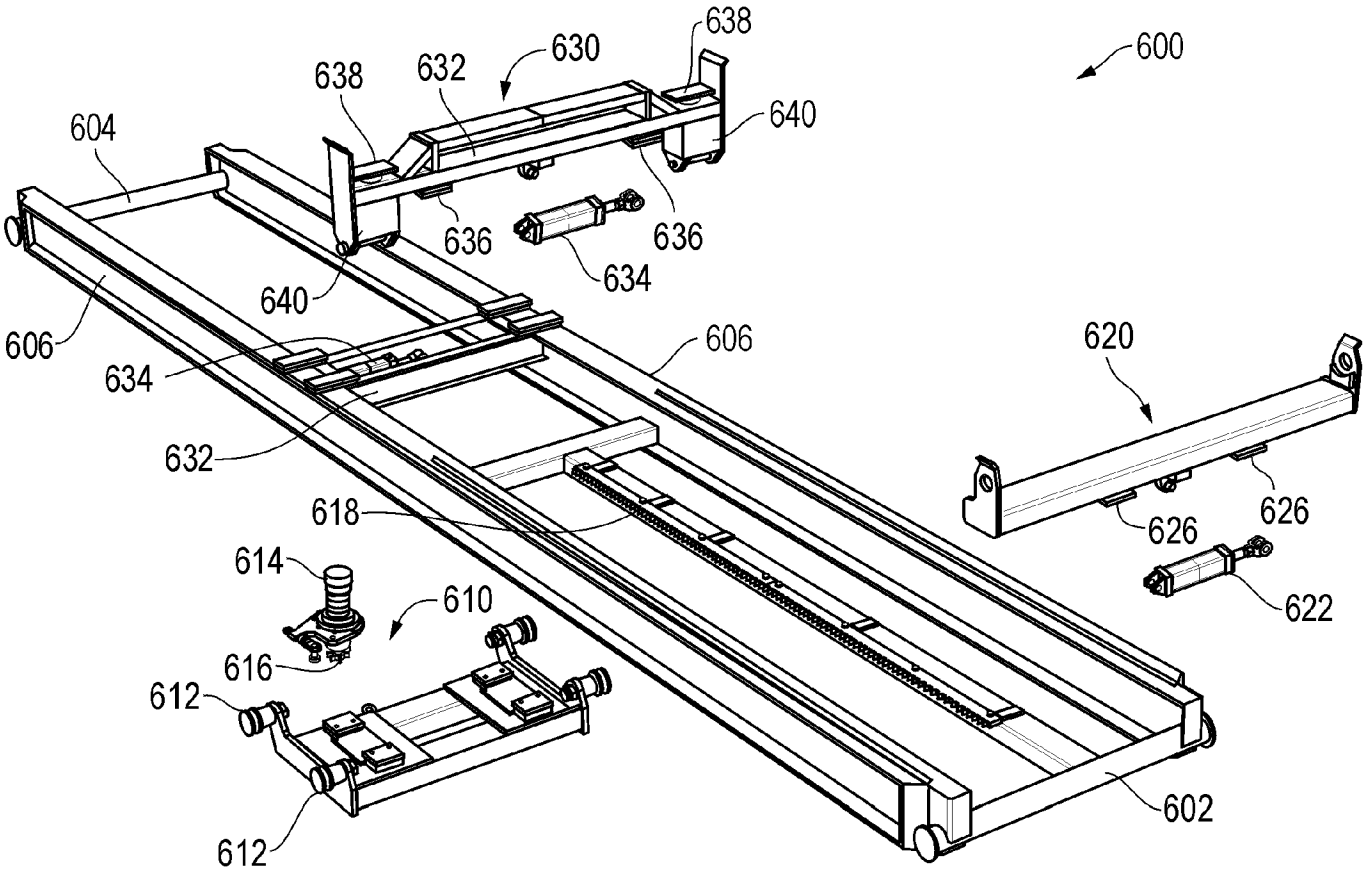
FIG. 2 is an isometric exploded view of a mast transport skid having certain features in accordance with the present invention.

FIG. 2 is an isometric exploded view of an embodiment of transport skid 600. Transport skid 600 is loadable onto a standard low-boy trailer as is well known in the industry. Transport skid 600 has a forward end 602 and a rearward end 604. Transport skid 600 supports a movable forward slider 620 and a rearward slider 630.

Forward slider 620 is mounted on a carriage 610. A forward hydraulic cylinder 622 is connected between carriage 610 and forward slider 620. A pair of front slider pads 626 may be located between forward slider 620 and frame sides 606.

Carriage 610 is located on skid 600 and movable in a direction between forward end 602 and rearward end 604, separated by skid sides 606. In one embodiment, a roller set 612 provides a rolling relationship between carriage 610 and skid 600.

A motor 614 is mounted on carriage 610. A pinion gear 616 is connected to motor 614. A rack gear 618 is mounted lengthwise on skid 600. Pinion gear 616 engages rack gear 618, such that operation of motor 614 causes movement of carriage 610 lengthwise along skid 600.

Rearward slider 630 is mounted on a rearward base 632. A rearward hydraulic cylinder 634 is connected between rearward slider 630 and rearward base 632. A pair of rear slider pads 636 may be located between rearward slider 630 and skid sides 606. In one embodiment, bearing pads 638 are located on the upper surface of rearward slider 630 for supporting mast section 220.

In one embodiment, an elevator 640 is located on each side of rearward slider 630, between rearward slider 630 and skid 600, each being movable between a raised and lowered position.

Figure 3:
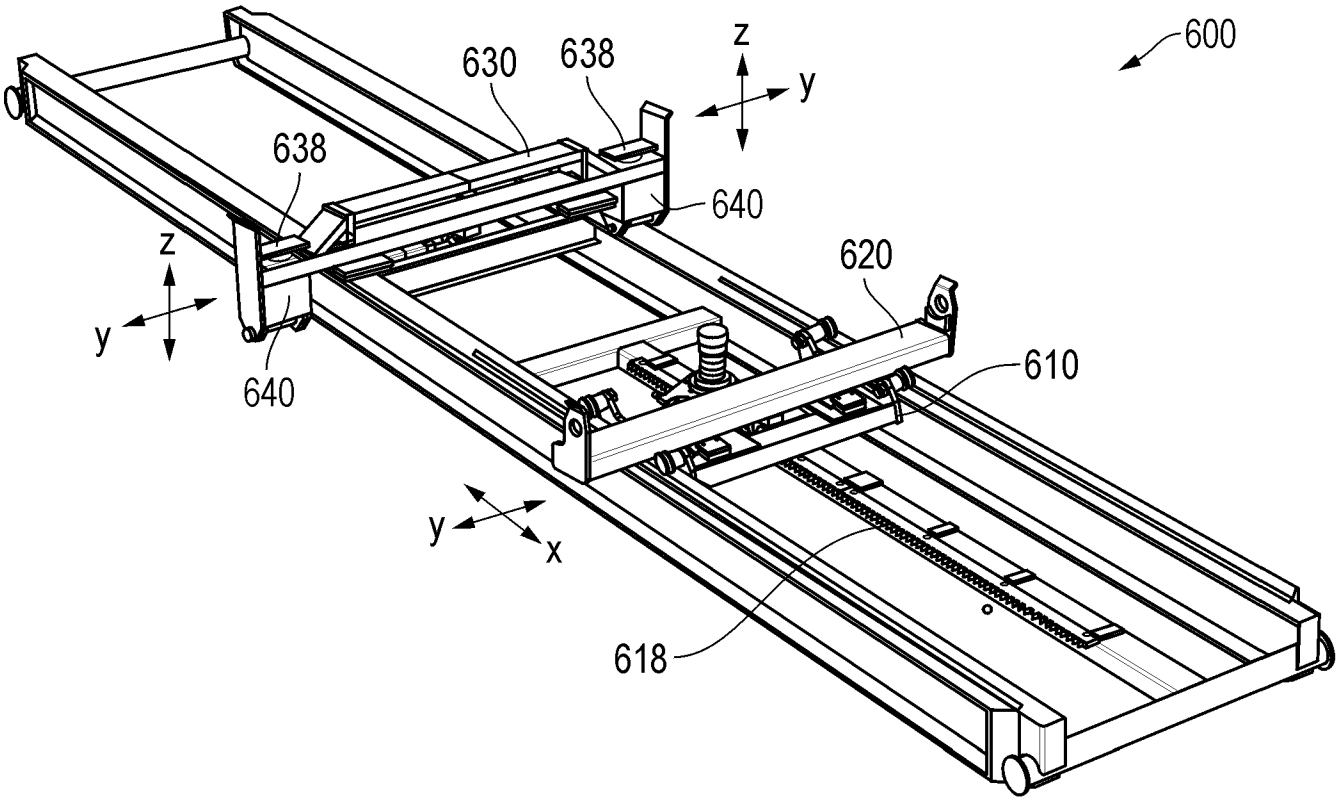
FIG. 3 is an isometric view of the mast transport skid of FIG. 2, illustrated assembled.

FIG. 3 is an isometric view of mast transport skid 600 of FIG. 2, illustrated assembled. Forward slider 620 is movable in the X-axis and Y-axis relative to skid 600. Actuation of motor 614 causes movement of forward slider 620 along the X-axis. Actuation of forward cylinder 622 causes movement of forward slider 620 along the Y-axis.

Rearward slider 630 is movable independent of forward slider 620. Rearward slider 630 is movable in the Y-axis and Z-axis relative to skid 600. Actuation of rearward cylinder 634 causes movement of rearward slider 630 along the Y-axis. Actuation of elevators 640 causes movement of rearward slider 630 along the Z-axis. In one embodiment, elevators 640 are independently operable, thus adding to the degrees of freedom of control of rearward slider 630.

Figure 4:
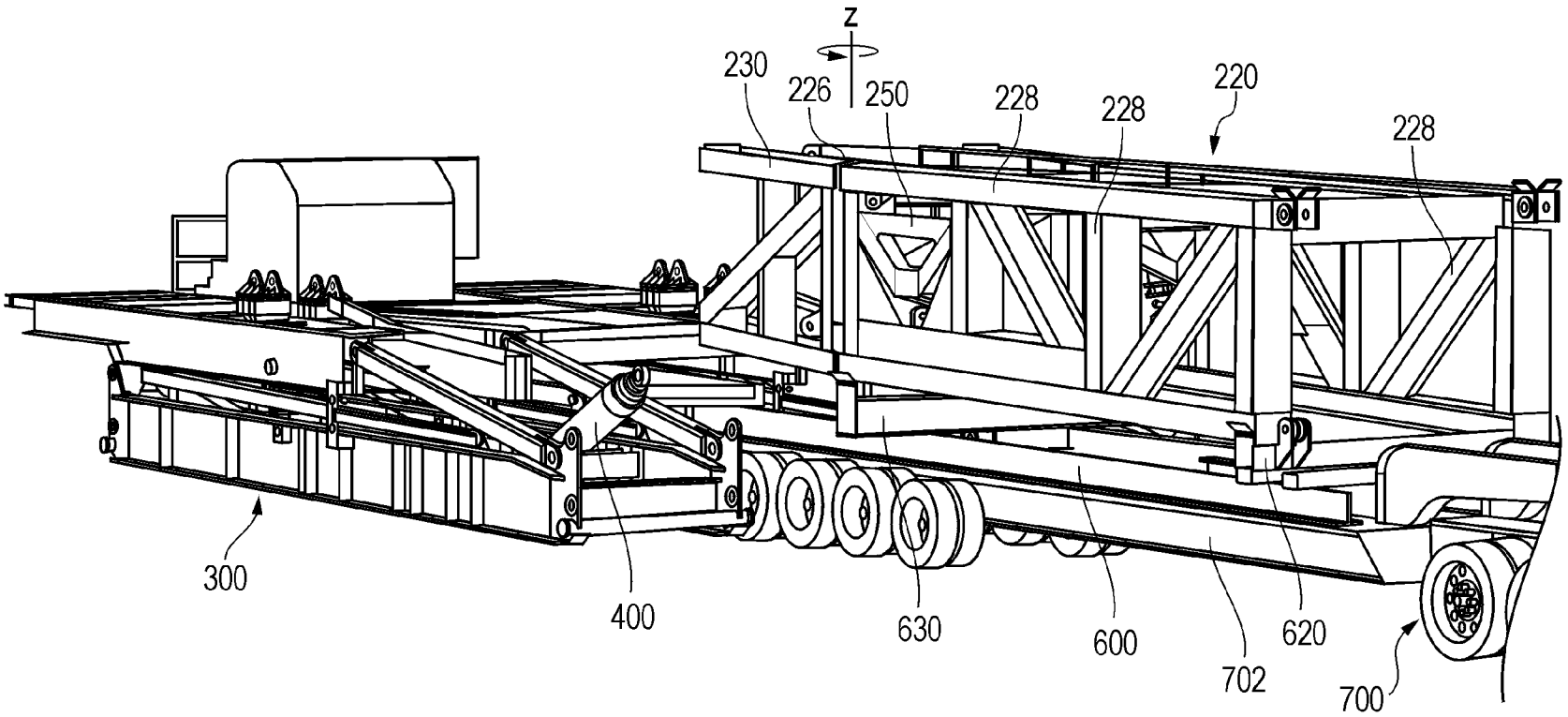
FIG. 4 is an isometric view of a first stage of the rig-up sequence for a drilling system, as performed in accordance with the present invention.

FIGS. 4 through 7 illustrate the initial stages of the rig-up sequence performed in accordance with the present invention. FIG. 4 is an isometric view of a first stage of the rig-up sequence for a drilling system, as performed in accordance with the present invention. Lower mast section 220 is carried on forward slider 620 and rearward slider 630 of transport skid 600. Transport skid 600 is mounted on a trailer 702 connected to a tractor 700.

A plurality of structural cross-members 222 (not shown) defines a mast framework width 224 (not shown) of lower mast section 220. At this stage of the sequence, mast legs 230 are in the retracted position, and within framework width 224. Also at this stage, wing brackets 250 are in the retracted position, and also within framework width 224. By obtaining a stowed position of mast legs 230 and wing brackets 250, the desired transportable framework width 224 of lower mast section 220 is achieved. Substructure 300 is in the collapsed position, on the ground, and being approached by tractor 700 and transport skid 600.

Figure 5:
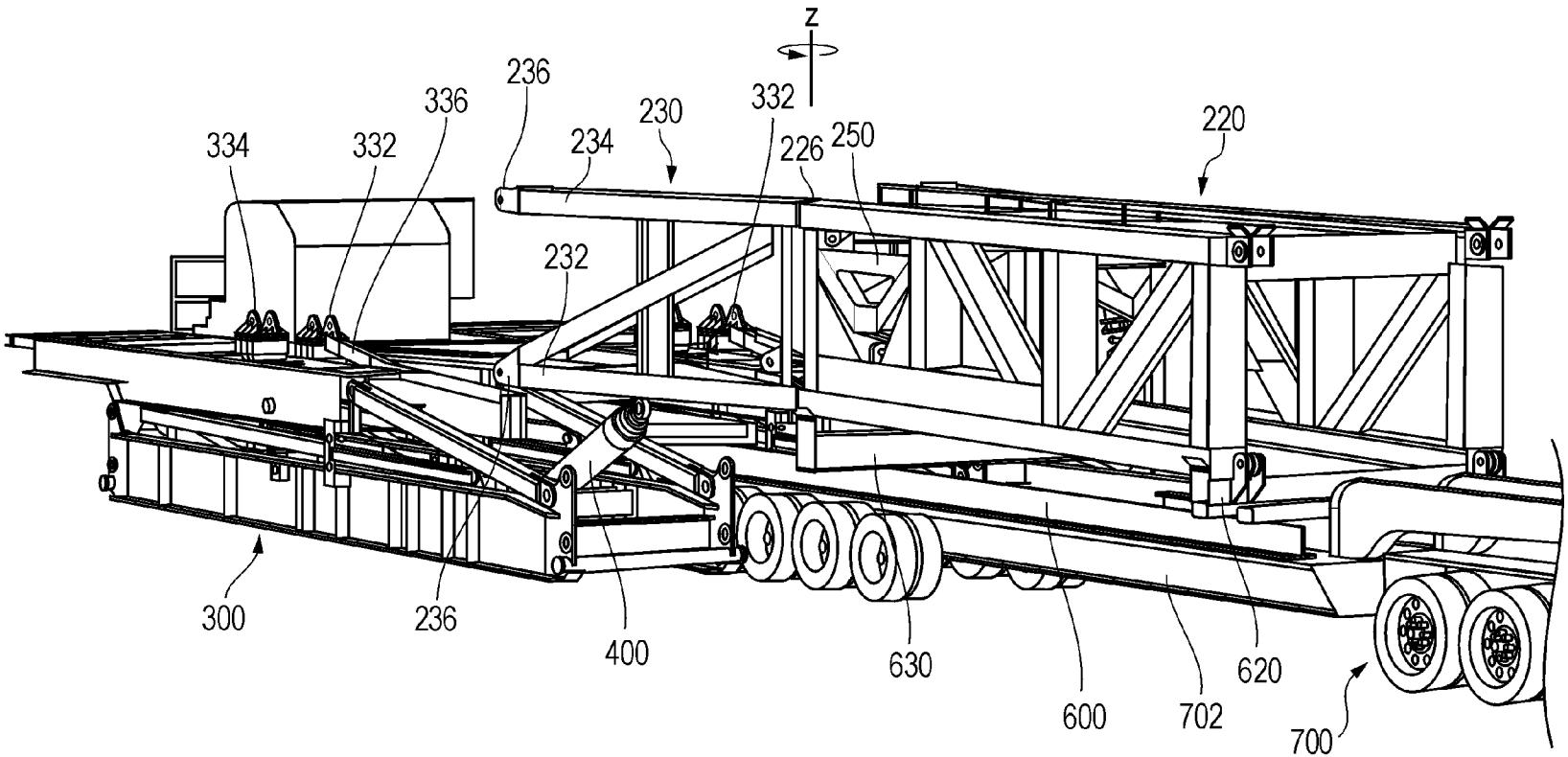
FIG. 5 is an isometric view of a second stage of the rig-up sequence for a drilling system, as performed in accordance with the present invention.

FIG. 5 is an isometric view of a second stage of the rig-up sequence for a drilling system, as performed in accordance with the present invention. At this stage, tractor 700 and trailer 702 are backed up to a position of closer proximity to substructure 300, which is on the ground in a collapsed position. Having moved mast legs 230 past the point of interference with raising cylinders 400, legs 230 are deployed by mast leg cylinders 238 (not shown), which rotates legs about the axis Z of pivot connection 226.

Each mast leg pair 230 has a front leg 232 and a rear leg 234. Shoe connectors 236 are located at the base of legs 230. Front shoes 332 and rear shoes 334 are located on drilling floor 330 for receiving shoe connectors 236 of front legs 232 and rear legs 234, respectively. A pair of inclined ramps 336 is located on drilling floor 330, inclining upwards towards front shoes 332.

Elevators 640 are actuated to raise rearward slider 630 and thus mast legs 230 of lower mast 220 along the Z-axis (FIG. 3) above obstacles related to substructure 300 as tractor 700 and trailer 702 are backed up to a position of closer proximity to substructure 300 (see FIG. 4). In this position (referring also to FIG. 2), forward cylinder 622 of forward slider 620 and rearward cylinder 634 of rearward slider 630 are actuated to finalize Y-axis (FIG. 3) alignment of mast legs 230 of lower mast section 220 with inclined ramps 336 (FIGS. 4 and 5). The option of like or opposing translation of forward slider 620 and rearward slider 630 along the Y-axis is especially beneficial for this purpose. Using this alignment capability, shoe connectors 236 of front legs 232 are aligned with inclined ramps 336.

Figure 6:
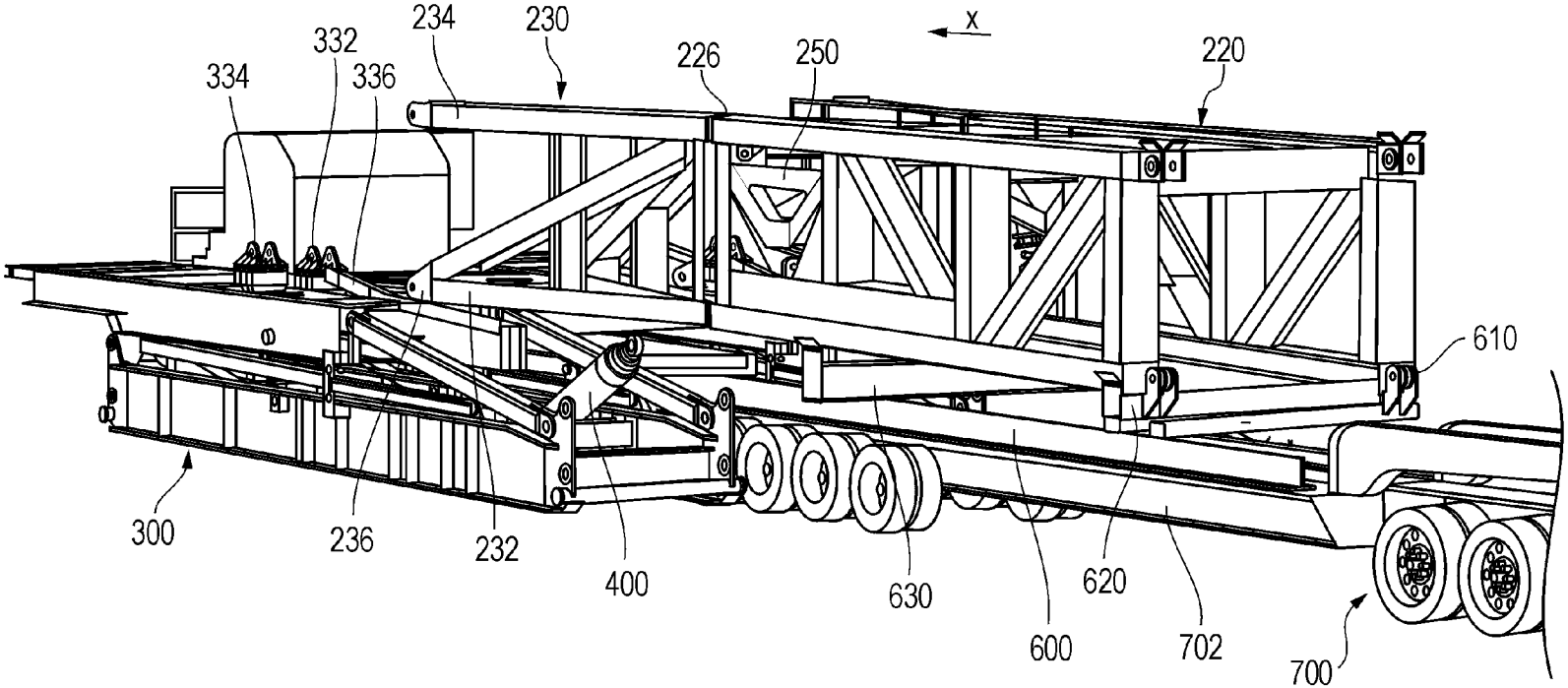
FIG. 6 is an isometric view of a third stage of the rig-up sequence for a drilling system, as performed in accordance with the present invention.

FIG. 6 is an isometric view of a third stage of the rig-up sequence for a drilling system, as performed in accordance with the present invention. In this stage, rearward slider 630 is lowered by elevators 640 (not visible), positioning shoe connectors 236 of front legs 232 onto inclined ramps 336. This movement disengages rearward slider 630 from lower mast section 220.

Carriage 610 is translated from forward end 602 towards rearward end 604. In one embodiment, this movement is accomplished by actuating motor 614. Motor 614 rotates pinion gear 616 which is engaged with rack gear 618, forcing longitudinal movement of carriage 610 and forward slider 620 along the X-axis (FIG. 3). As a result, lower mast section 220 is forced over substructure 300, as shoe connectors 236 slide up inclined ramps 336.

Figure 7:
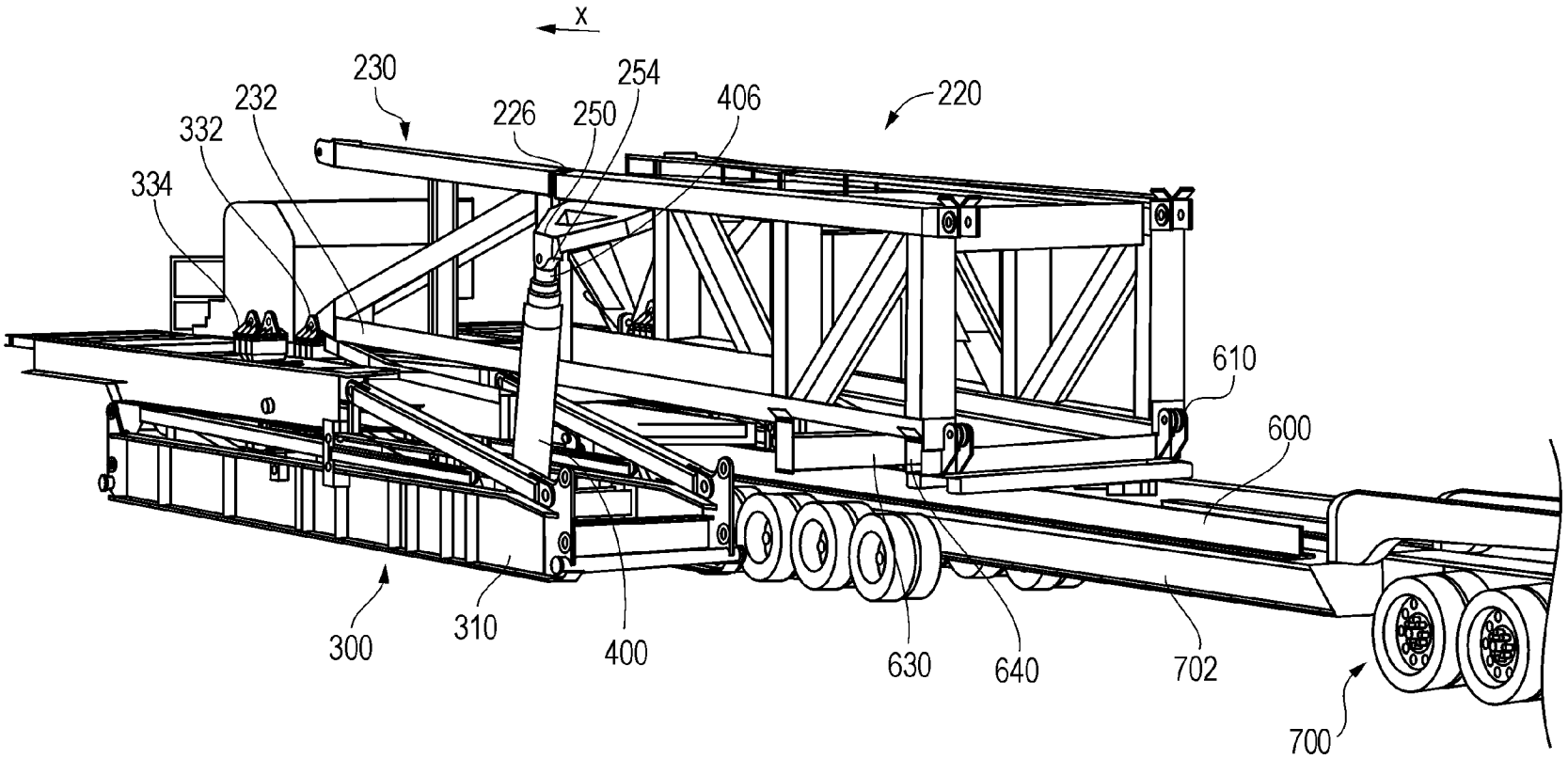
FIG. 7 is an isometric view of a fourth stage of the rig-up sequence for a drilling system, as performed in accordance with the present invention.

FIG. 7 is an isometric view of a fourth stage of the rig-up sequence for a drilling system, as performed in accordance with the present invention. As shoe connectors 236 reach the top of inclined ramps 336, they align with, and are connected to, front leg shoes 332.

In the embodiment described, wing brackets 250 (FIG. 9) are pivotally connected to lower mast section 220 proximate to, and above, pivot connections 226 (FIG. 7). Wing brackets 250 are movable between a transportable stowed position and the illustrated deployed position.

Figure 9:
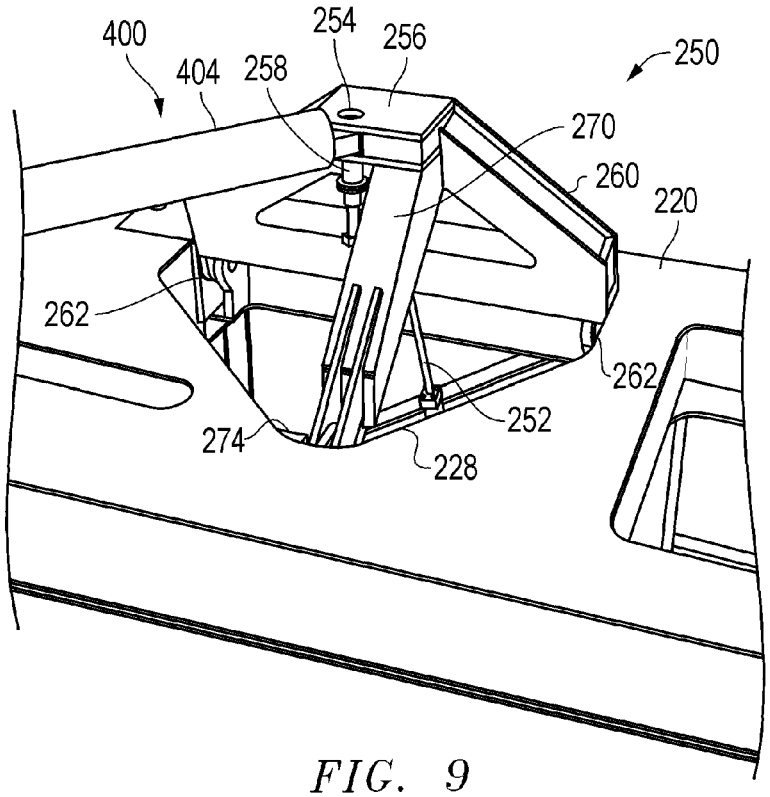
FIG. 9 is an isometric view of the wing bracket of FIG. 8, illustrated in the deployed position relative to a lower mast section.

A wing cylinder 252 (FIG. 9) may be connected between lower mast section 220 and each wing bracket 250 for facilitating movement between the stowed and deployed positions. Connection sockets 254 are provided on the ends of wing brackets 250 for connection to raising cylinder 400. As shown in FIGS. 7 and 9, wing brackets 250 are moved into the deployed position by actuating wing cylinders 252 (FIG. 9).

Raising cylinder 400 is pivotally connected to base box 310. In a preferred embodiment, raising cylinder 400 has a lower end 402 pivotally connected to base box 310 at a location between the pivotal connections of substructure legs 340 to base box 310 (see FIG. 18). Raising cylinder 400 has an opposite articulating end 404 (see FIG. 9). In a preferred embodiment, raising cylinder 400 is a multi-stage telescoping cylinder capable of extension of a first stage 406, a second stage 408 and a third stage 410. A positioning cylinder 412 may be connected to each raising cylinder 400 for facilitating controlled rotational positioning of raising cylinder 400.

In the stage of the rig-up sequence illustrated in FIG. 7, raising cylinders 400 are pivotally moved into alignment with deployed wing brackets 250 for connection to sockets 254. Notably, raising cylinders 400 bypass the transported framework width 224 of lower mast section 220 in order to connect to wing brackets 250 on the far side of lower mast section 220. It is thus required that mast raising cylinders 400 be separated by a distance slightly greater than framework width 224. Lower mast section 220 is now supported by wing brackets 250. This is accomplished by the present invention without the addition of separately transported and assembled mast sections.

As described above, an embodiment of the invention further includes a retractable push point for raising substructure 300 significantly above drill floor 330 and significantly forward of lower mast section 220.

Lower mast section 220 is lifted slightly by extension of first stage 406 of raising cylinder 400, disengaging lower mast section 220 from transport skid 600, allowing tractor 700 and trailer 702 to depart.

As seen in FIG. 7, mast legs 230 are pivotally deployed about first pivot axis Z (at 226), and wing brackets 250 are pivotally deployed about second pivot axis 264 that is substantially perpendicular to first pivot axis Z (at 226).

Figure 8:
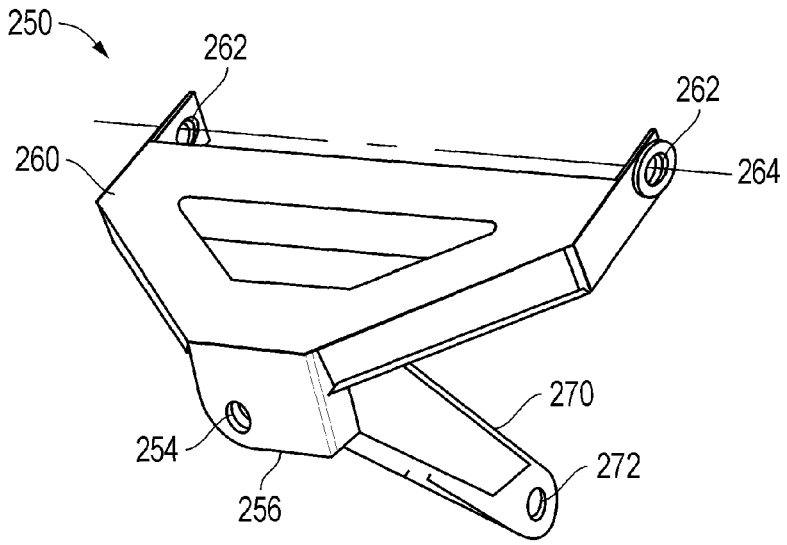
FIG. 8 is an isometric view of the wing bracket illustrated in accordance with an embodiment of the present invention.

FIG. 8 is an isometric view of wing bracket 250 in accordance with an embodiment of the present invention. FIG. 9 is an isometric view of wing bracket 250 in the deployed position relative to lower mast section 220. Referring to the embodiment of wing bracket 250 illustrated in FIG. 8, wing bracket 250 is comprised of a framework 260 designed to fit within a portal 228 in lower mast section 220 (see FIG. 9). Frame 260 has a pair of sockets 262 for pivotal connection to lower mast section 220 within portal 228. The pivotal connection defines an axis 264 about which wing bracket 250 is deployed and stowed. In one embodiment, axis 264 is substantially perpendicular to first pivot axis Z (at 226) about which legs 230 are deployed and stowed.

A lug box 256 extends from frame 260. Socket 254 is located on lug box 256. An arm 270 extends inward towards the interior of lower mast section 220. A bracket socket 272 is located near the end of arm 270.

Referring to FIG. 9, wing cylinder 252 extends between lower mast section 220 and arm 270 to deploy and stow wing bracket 250. In the deployed position, a bracket locking pin 274 extending through portal 228 passes through bracket socket 272 (FIG. 8) to lock wing bracket 250 in the deployed position. With wing bracket 250 locked in the deployed position, raising cylinder 400 is extended. Lug box 256 receives articulating end 404 of raising cylinder 400. A raising cylinder locking pin 258 is hydraulically operable to pass through articulating end 404 and socket 254 to lock raising cylinder 400 to wing bracket 250.

Figure 10:
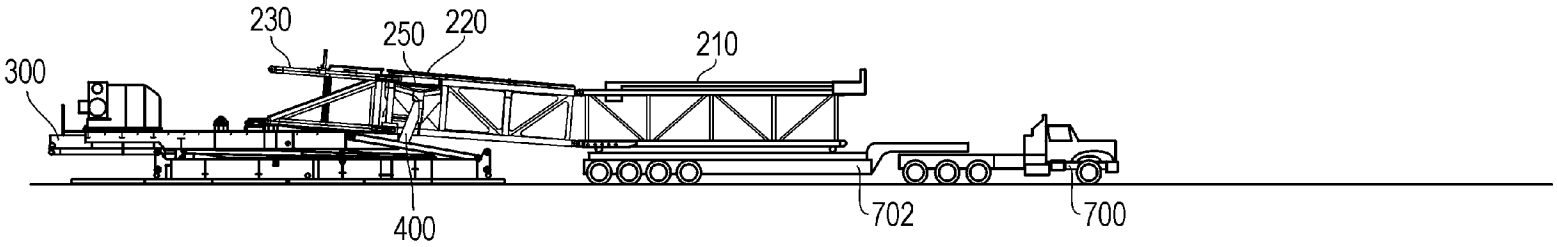
FIGS. 10, 11 and 12 are side views illustrating a fifth, sixth and seventh stage of the rig-up sequence for a drilling system, as performed in accordance with the present invention.
Figure 11:
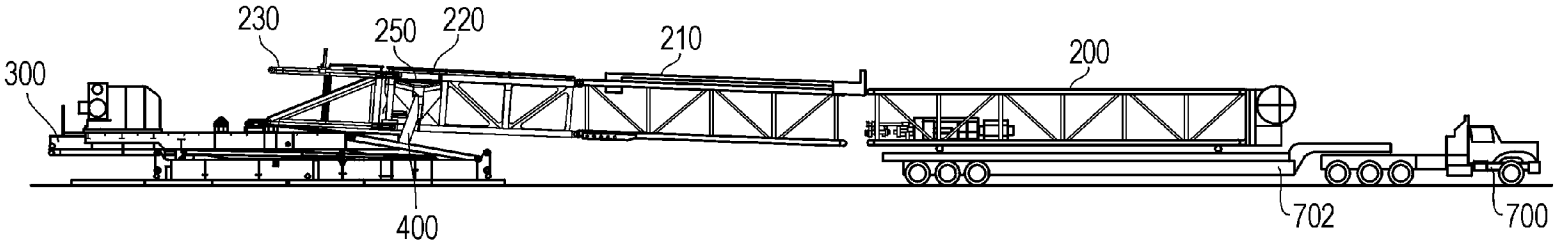
Figure 12:
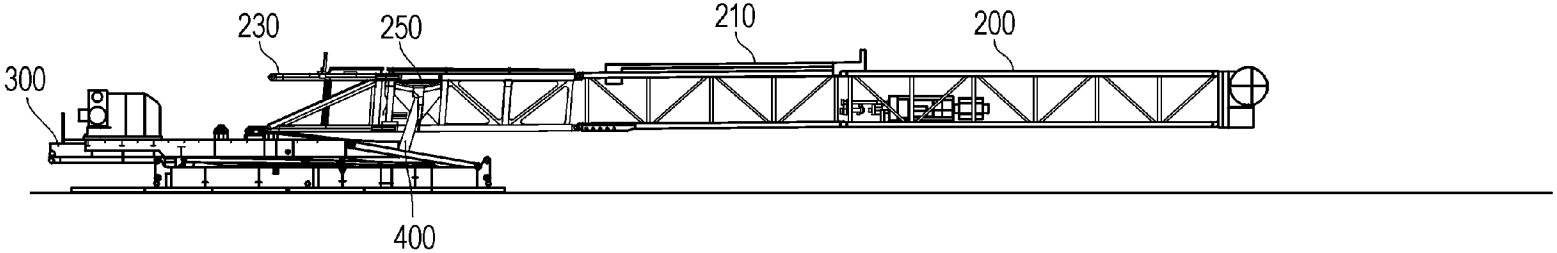

FIGS. 10, 11 and 12 are side views illustrating a fifth, sixth and seventh stage of the rig-up sequence for a drilling system, as performed in accordance with the present invention. Referring to FIGS. 10 through 11, it is seen that subsequent tractor 700 and trailer 702 carry central mast section 210 for connection to lower mast section 220, and carry upper mast section 200 for connection to central mast section 210. At this time, the weight of the collective mast sections is born by the raising cylinder 400 as transmitted through the wing brackets 250. Raising cylinder 400 can be extended to align connected mast sections with each incoming mast section. For example, raising cylinder 400 can be extended to align connected mast sections 210 with 220, and 200 with 210.

Figure 13:
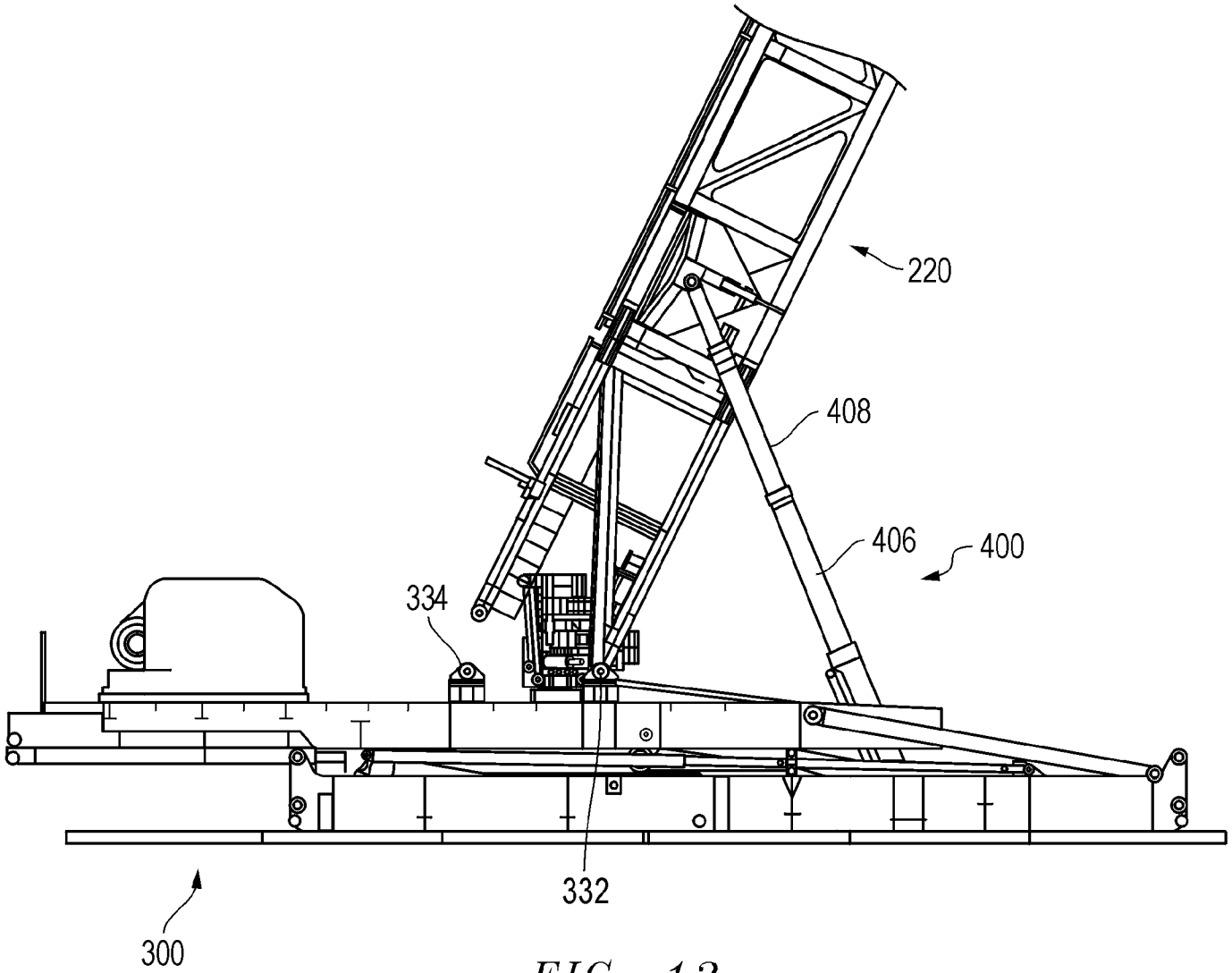
FIG. 13 is a side view of an eighth stage of the rig-up sequence for a drilling system, as performed in accordance with the present invention.
Figure 14:
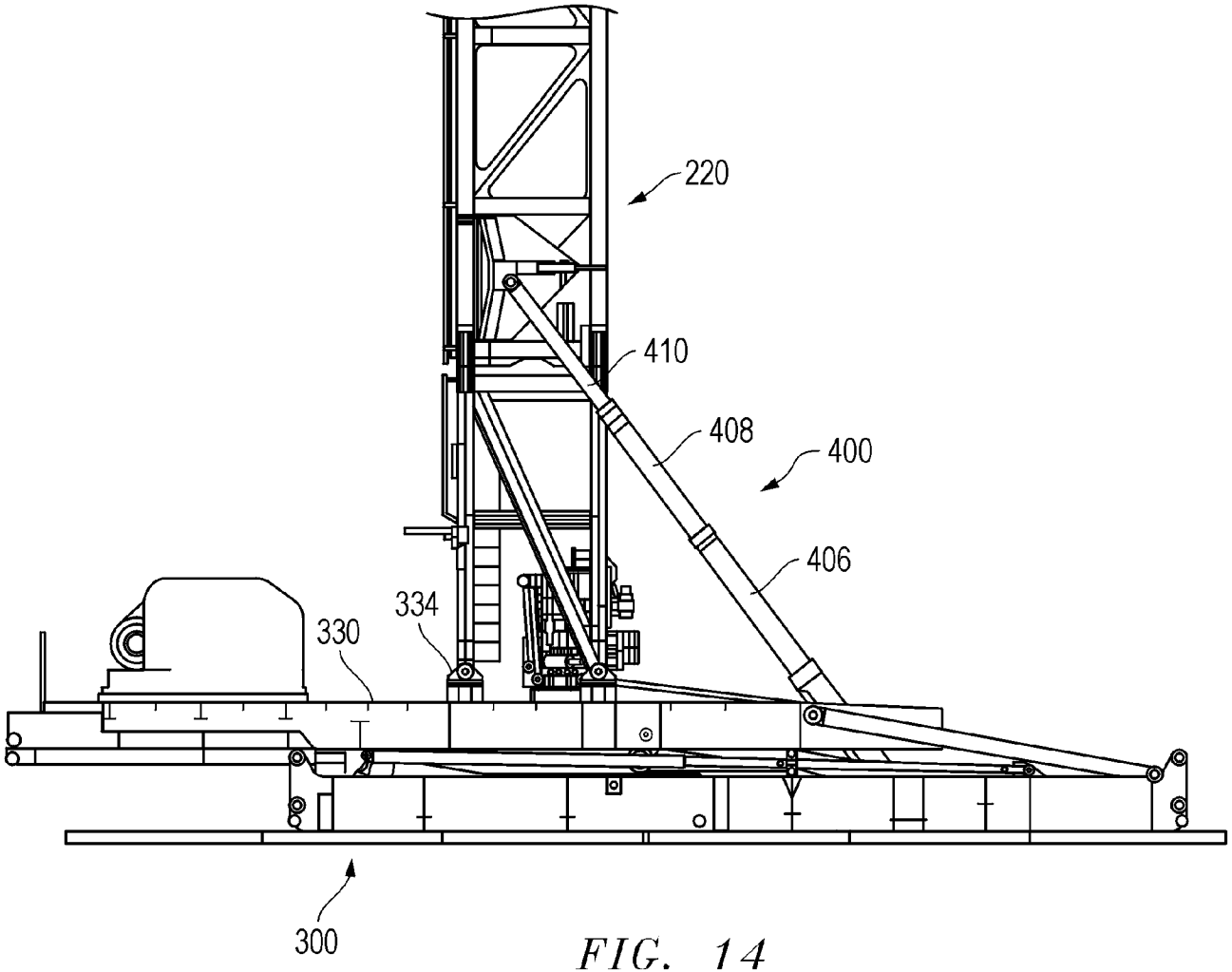
FIG. 14 is a side view of a ninth stage of the rig-up sequence for a drilling system, as performed in accordance with the present invention.

FIGS. 13 and 14 are side views illustrating an eighth and ninth sequence for a drilling system, as performed in accordance with the present invention. In these steps, lower mast section 220 (and connected central and upper mast sections 210 and 200) is raised into a vertical position. In FIG. 13, lower mast section 220 is illustrated pivoted upwards by extension of first stage 406 and second stage 408 of raising cylinder 400. In FIG. 14, lower mast section 220 is illustrated pivoted into the fully vertical position by extension of third stage 410 of raising cylinder 400.

Figure 15:
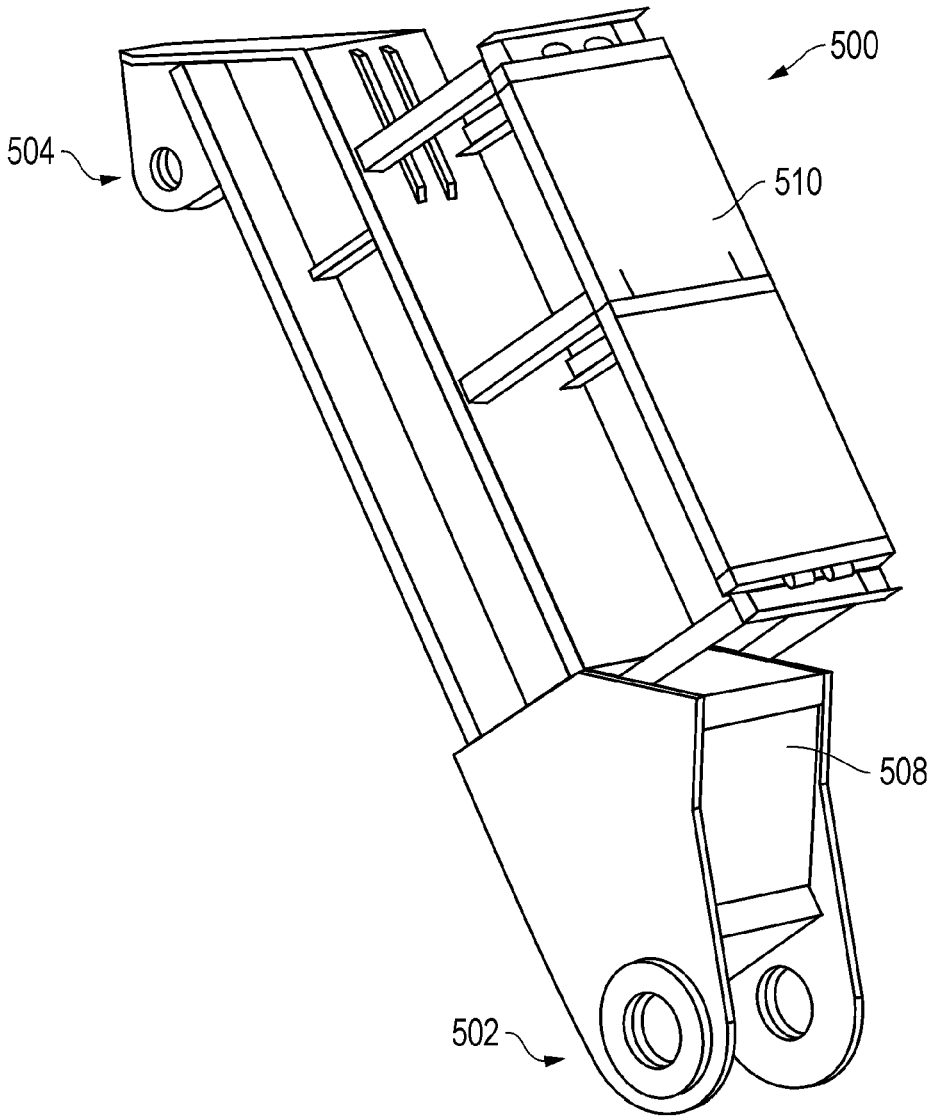
FIG. 15 is an isometric view of a retractable cantilever, shown in accordance with the present invention.

FIG. 15 is an isometric view of cantilever 500, shown in accordance with the present invention. Cantilever 500 has a lower end 502 for pivotal connection to drill floor framework 320 of substructure 300. Cantilever 500 has an upper end 504 for connection to articulating end 404 of raising cylinder 400. A load pad 508 is provided for load bearing engagement with a beam brace 328 (not shown) located on substructure 300. A backer panel 510 provides a complementary section of drill floor 330 when cantilever 500 is in the stowed position.

Cantilever 500 is movable between a transportable stowed position and a deployed position. In the stowed position, cantilever 500 is located beneath drill floor 330. In the deployed position, upper end 504 of cantilever 500 is raised above drill floor 330 for connection to articulating end 404 of raising cylinder 400. A cantilever cylinder 506 (not shown) may be provided for moving cantilever 500 between the transportable stowed position and the deployed position.

Figure 16:
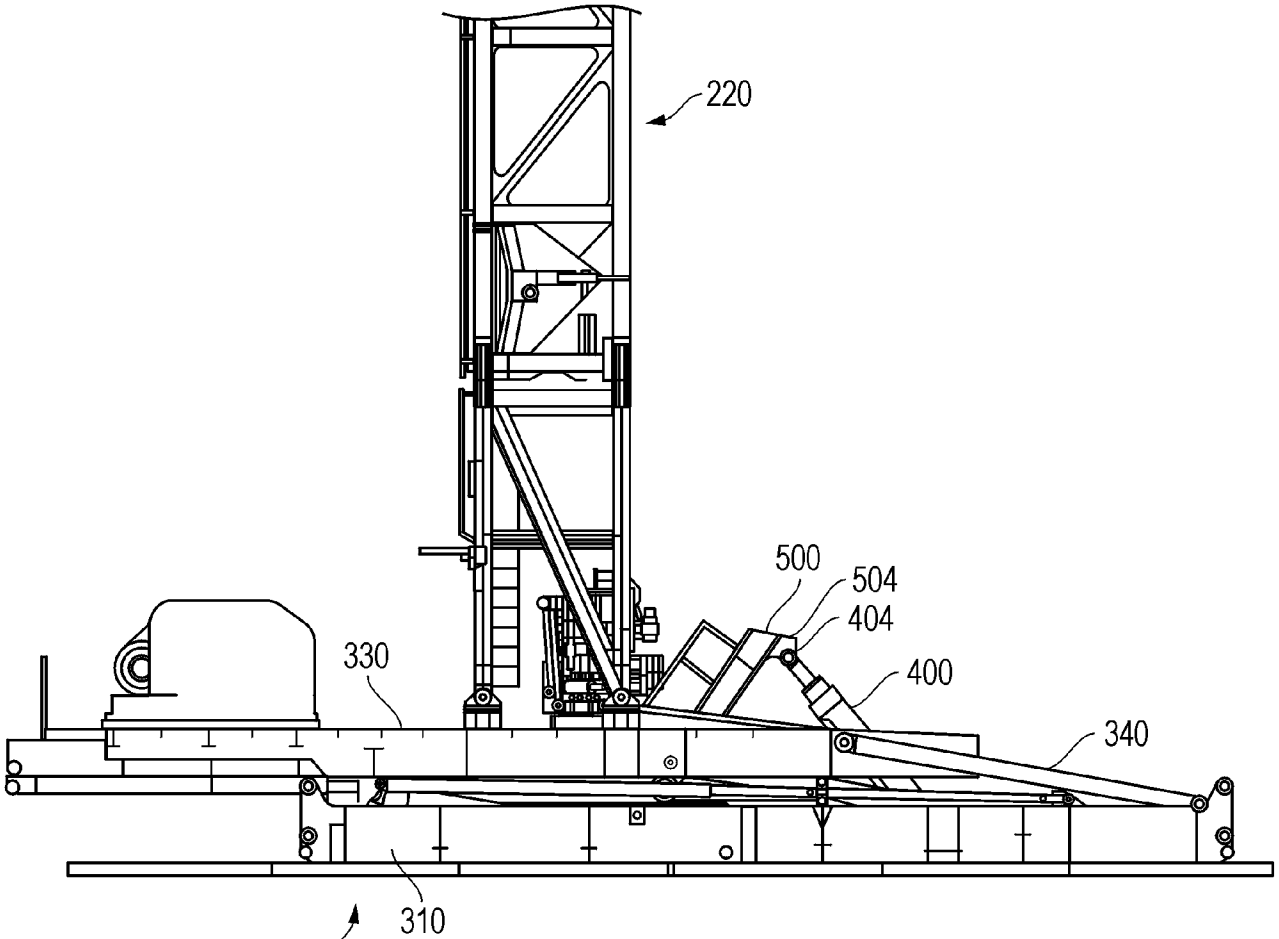
FIG. 16 is a side view of a tenth stage of the rig-up sequence for a drilling system, as performed in accordance with the present invention.

FIGS. 16, 17, 18, and 19 are side views illustrating tenth, eleventh, twelfth, and thirteenth stages of the rig-up sequence for a drilling system, illustrating the erection of substructure 300, as performed in accordance with the present invention. In FIG. 16, raising cylinder 400 has been detached from wing brackets 250, and articulating end 404 of raising cylinder 400 has been retracted. Wing brackets 250 may remain in the deployed position during drilling operations.

Cantilever 500 has been moved from the stowed position beneath drill floor 330 into the deployed position in which upper end 504 of cantilever 500 is above drill floor 330. Cantilever 500 may be moved between the stowed and deployed positions by actuation of cantilever cylinder 506. Upper end 504 of cantilever 500 is connected to articulating end 404 of raising cylinder 400. In this position, load pad 508 of cantilever 500 is in complementary engagement with beam brace 328 for transmission of lifting force as applied by raising cylinder 400.

Figure 17:
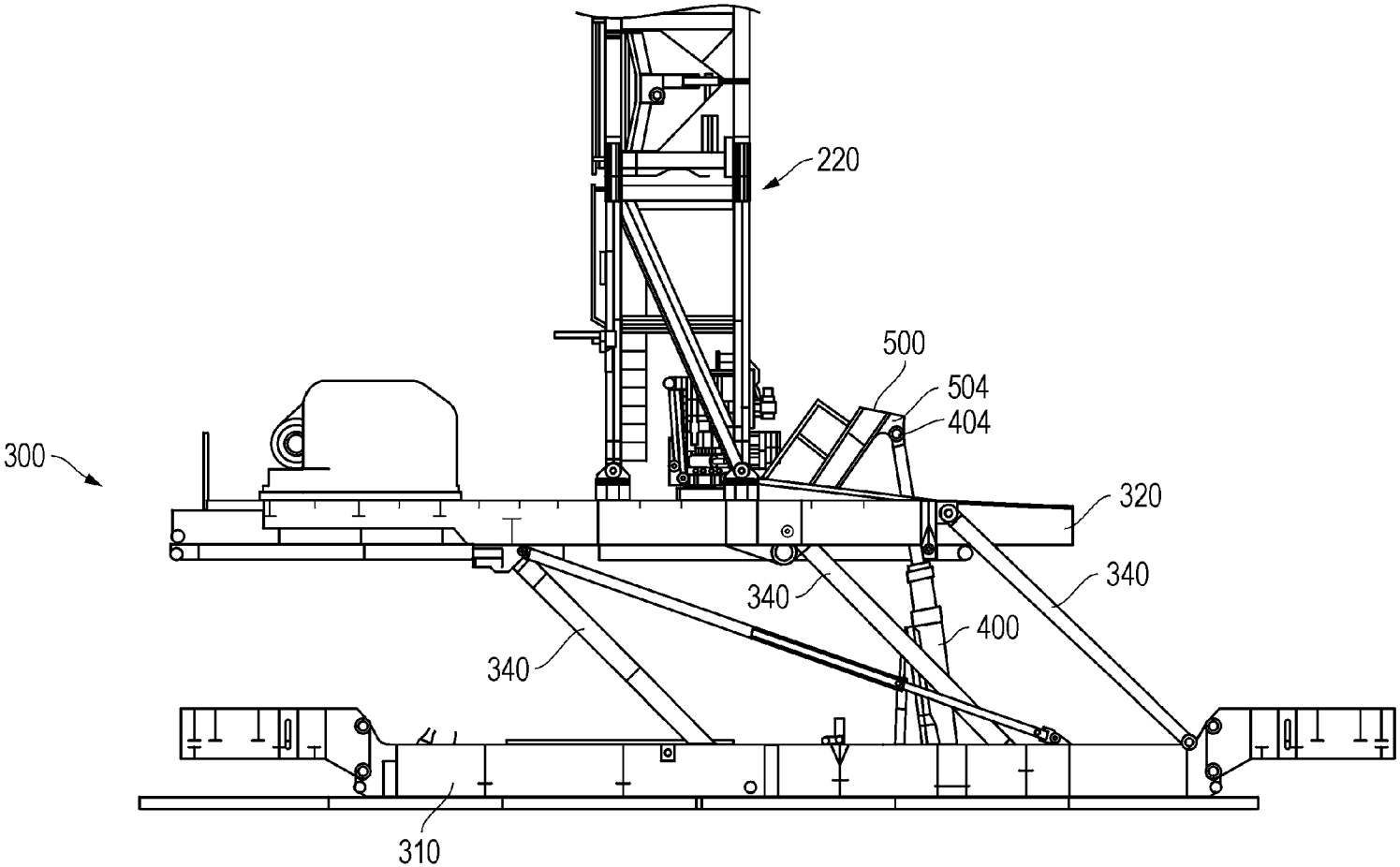
FIG. 17 is a side view of an eleventh stage of the rig-up sequence for a drilling system, as performed in accordance with the present invention.

FIG. 17 is a side view of an eleventh stage of the rig-up sequence for a drilling system, as performed in accordance with the present invention. In the view, first stage 406 of raising cylinder 400 is fully extended and second stage 408 (FIG. 18) is being initiated. As a result of the force being applied on cantilever 500, as transferred to beam brace 328, drill floor framework 320 is raising off of base box 310 as substructure 300 is moved towards an erected position.

Figure 18:
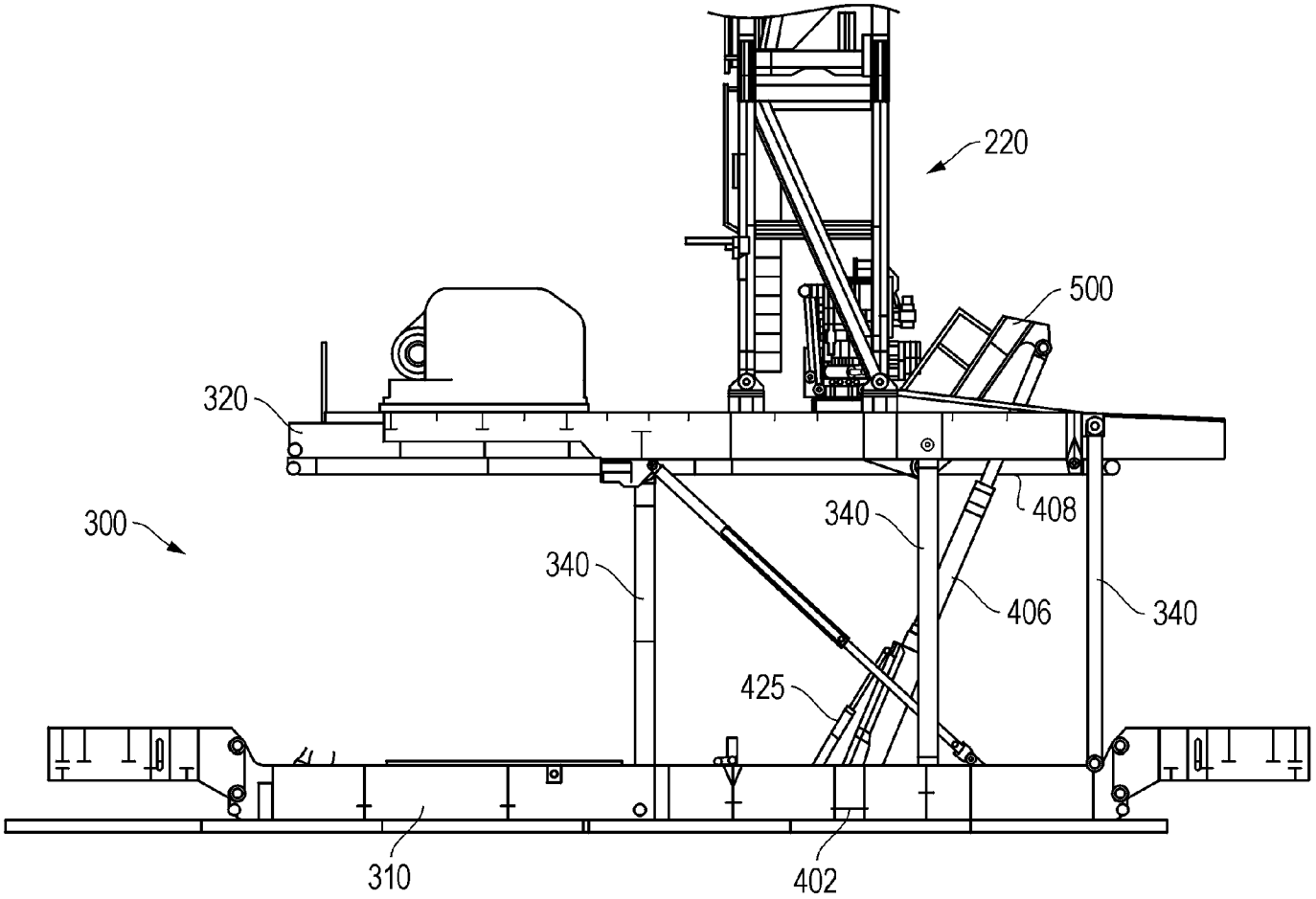
FIG. 18 is a side view of a twelfth stage of the rig-up sequence for a drilling system, as performed in accordance with the present invention.

FIG. 18 is a side view of a twelfth stage of the rig-up sequence for a drilling system, as performed in accordance with the present invention. In this view, first stage 406 and second stage 408 of raising cylinder 400 have been extended to lift drill floor framework 320 over base box 310 as substructure 300 is moved into the fully deployed position with substructure legs 340 supporting the load of mast sections 200, 210, 220, and drill floor framework 320. Conventional locking pin mechanisms and diagonally oriented beams are used to prevent further rotation of substructure legs 340, and thus maintain substructure 300 in the deployed position.

Figure 19:
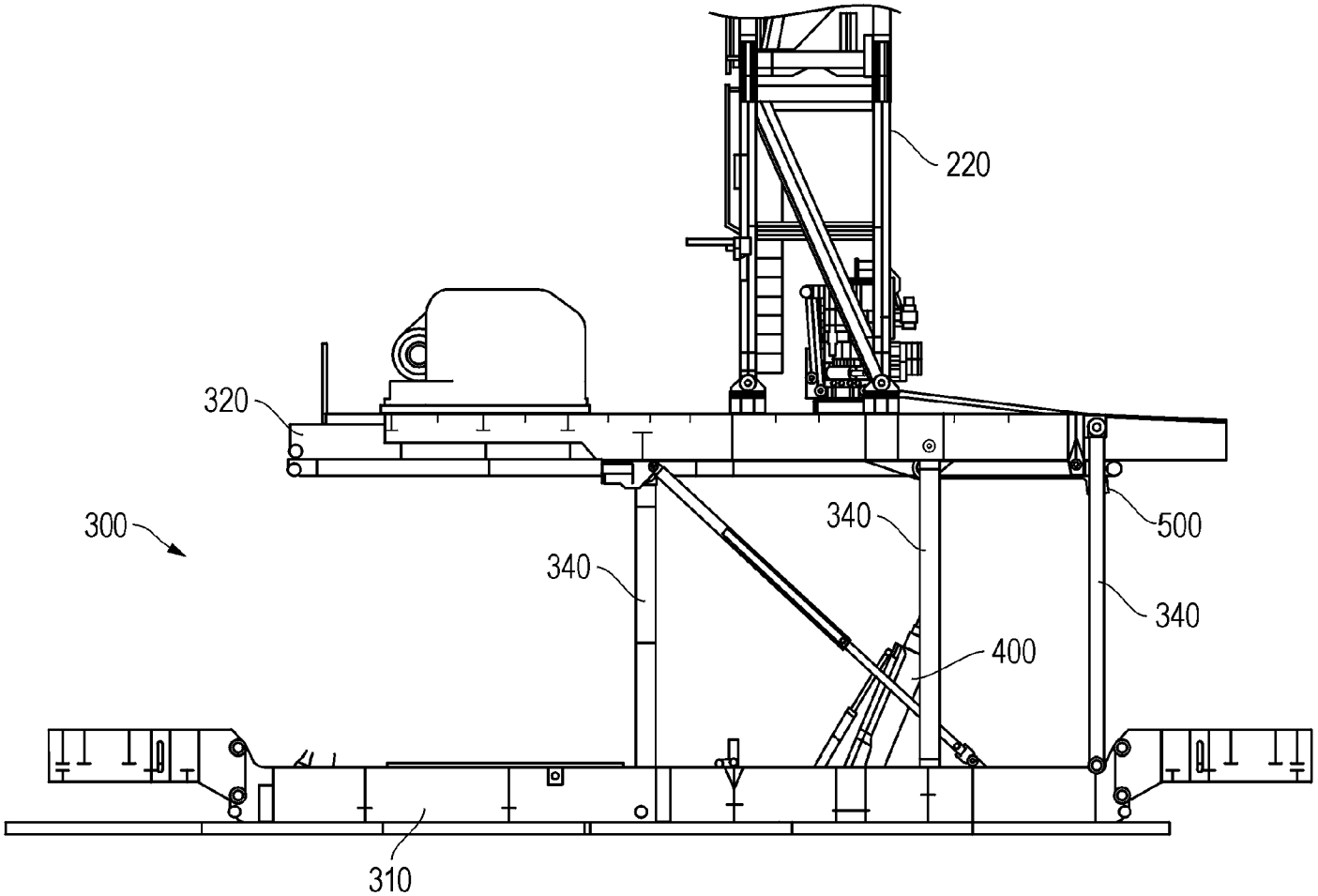
FIG. 19 is a side view of a thirteenth stage of the rig-up sequence for a drilling system, as performed in accordance with the present invention.

FIG. 19 is a side view of a thirteenth stage of the rig-up sequence for a drilling system, as performed in accordance with the present invention. In this view, articulating end 404 of raising cylinder 400 is disconnected from upper end 504 of cantilever 500. Raising cylinder 400 is then retracted. Cantilever 500 is moved into the stowed position by actuation of cantilever cylinder 506. In the stowed position, backer panel 510 of cantilever 500 becomes a part of drill floor 330, providing an unobstructed space for crew members to perform drilling operations.

Figure 20:
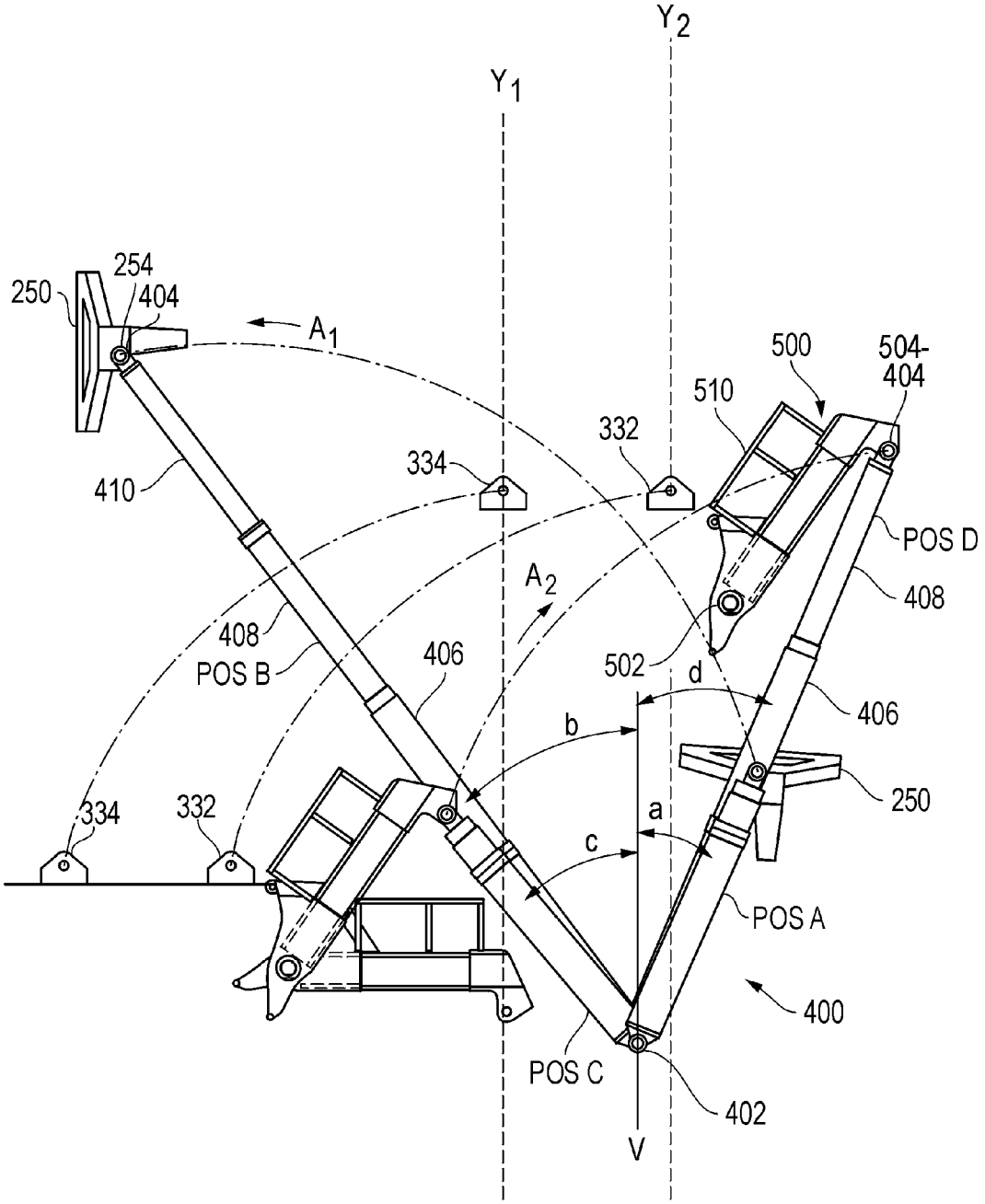
FIG. 20 is a diagram of the relationships between the mast and substructure raising components of the present invention.

FIG. 20 is a diagram of the relationships between lower mast section 220 and substructure 300 raising components 250, 400 and 500 of the present invention. More specifically, FIG. 20 illustrates one embodiment of preferred kinematic relationships between deployable wing bracket 250, deployable cantilever 500 and raising cylinder 400.

In one embodiment, upper end 504 of cantilever 500 is deployed to a location above drill floor 330 that is also forward of front leg shoes 332. In one embodiment, pivotally connected end 402 of raising cylinder 400 is connected to substructure 300 at a location beneath and generally between front leg shoes 332 and rear leg shoes 334 of drill floor 330 of erected substructure 300. Also in this embodiment, lower end 502 of cantilever 500 is pivotally connected at a location beneath drill floor 330 and forward of front leg shoes 332.

As was seen in an embodiment illustrated in FIG. 7, mast legs 230 are pivotally deployed about a first pivot axis, and wing brackets 250 are pivotally deployed about a second pivot axis that is substantially perpendicular to the first pivot axis of mast legs 230. Cantilever 500 is deployed about a third pivot axis that is substantially perpendicular to the first and second pivot axes of mast legs 230 and wing brackets 250, respectively.

As seen in FIG. 1, there is a pair of raising cylinders 400, each raising cylinder 400 connectable to a cantilever 500 and a wing 250. In a preferred embodiment, the pair of raising cylinders 400 rotates in planes that are parallel to each other. In another preferred embodiment, cantilevers 500 rotate in planes that are substantially within the planes of rotation of the raising cylinders. This configuration has a number of advantages related to the alignment and connection of upper end 504 of cantilever 500 to articulating end 404 of raising cylinder 400. This embodiment also optimizes accessibility of the deployed cantilevers 500 of sufficient size to carry the significant sub-lifting load beneath and above the very limited space on drill floor 330 and within drill floor framework 320. This embodiment also provides deployed engagement of load pad 508 with a beam brace 328 located on substructure 300, without placing a misaligned load of the pivotal connections of cantilevers 500 and cylinders 400. It will be understood by one of ordinary skill in the art that a modest offset of the planes would behave as a substantial mechanical equivalent of these descriptions.

As was seen in an embodiment illustrated in FIGS. 4-8, mast legs 230 are pivotally deployed about a first pivot axis Z (at 226), and wing brackets 250 are pivotally deployed about a second pivot axis 264 that is substantially perpendicular to first pivot axis Z (at 226) of mast legs 230. Cantilever 500 is deployed about a third pivot axis that is substantially perpendicular to the first and second pivot axes of mast legs 230 and wing brackets 250, respectively. This embodiment is advantageous in that mast legs 230 may be pivoted about an axis that reduces the transport width of the mast. It is further advantageous in that the wings remain gravitationally retracted during transportation, and when deployed.

One such plane of rotation is illustrated in FIG. 20. As illustrated in FIG. 20, when connected to deployed wing brackets 250, articulating end 404 forms a first arc A1 upon extension of raising cylinder 400. Arc A1 is generated in a first arc direction as mast sections 200, 210 and 220 are raised.

When connected to deployed cantilever 500, articulating end 404 forms a second arc A2 upon extension of raising cylinder 400. Arc A2 is generated in a second arc direction opposite that of A1, as collapsed substructure 300 is raised.

A vertical line through the center of pivotally connected end 402 of cantilever 400 is illustrated by axis V. In a preferred embodiment, the intersection of first arc A1 and second arc A2 relative to axis V, is located within + or −10 degrees of axis V.

In one embodiment illustrated in FIG. 20, the angular disposition of raising cylinder 400 has four connected positions. The sequential list of the connected positions is: a) retracted connection to wing brackets 250; b) extended connection to wing brackets 250; c) retracted connection to cantilever 500; and d) extended connection to cantilever 500. In the embodiment illustrated in FIG. 20, the angular disposition of raising cylinder 400 in position a is within 10 degrees of position d, and the angular disposition of raising cylinder 400 in position b is within 10 degrees of position c. The angular disposition of each position a, b, c, and d to vertical axis V is denoted as angles a', b', c', and d', respectively.

Having connected positional alignments within approximately 10 degrees optimizes the power and stroke of raising cylinder 400. Also, having connected positional alignments b and c within approximately 10 degrees speeds alignment and rig-up of drilling system 100.

Figure 21:
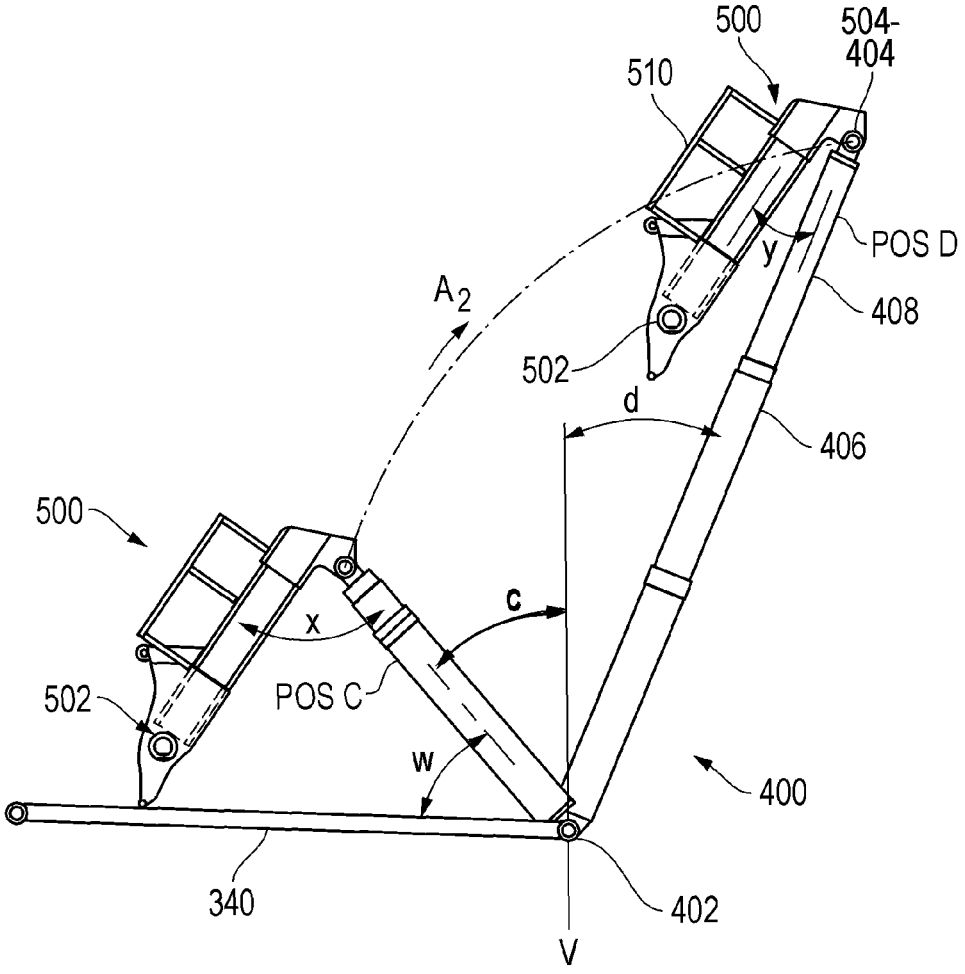
FIG. 21 is a diagram of certain relationships between the raising cylinder, the deployable cantilever, and the substructure of the present invention.

FIG. 21 is a diagram of the relationship between raising cylinder 400, deployable cantilever 500 and substructure leg 340. In this diagram, substructure leg 340 is relocated for visibility of the angular relationship to raising cylinder 400, as represented by angle w. Angle w is critical to the determination of the load capacity requirement of raising cylinder 400. Without the benefit of the higher push point provided by deployable cantilever 500, angle w would be approximately 21 degrees of lees for the embodiment shown. By temporarily raising the push point or pivotally connected end 402 above drill floor 330, w is increased, lowering the load capacity requirement of raising cylinder 400.

Provided in combination with deployable wing brackets 250, the configuration of drilling rig assembly 100 of the present invention permits the optimal sizing of mast raising cylinders 400, as balanced between retracted dimensions, maximum extension and load capacity, all within the fewest hydraulic stages. Specifically, mast raising cylinders 400 can achieve the required retracted and extended dimensions to attach to wing brackets 250 and extend sufficiently to fully raise mast sections 200, 210 and 220, while also providing an advantageous angular relationship between substructure legs 340 and raising cylinder 400 such that sufficient lift capacity is provided to raise substructure 300. This is all accomplished with the fewest cylinder stages possible, including first stage 406, second stage 408 and third stage 410.

As seen in the embodiment illustrated in FIG. 21, connection of upper end 504 of cantilever 500 to articulating end 404 of raising cylinder 400, when substructure 300 is in the stowed position, forms an angle x between cantilever 500 and raising cylinder 400 of between 70 and 100 degrees. Extension of raising cylinder 400 to deploy substructure 300 reduces the angle between cantilever 500 and raising cylinder 400 to between 5 and 35 degrees.

Figure 22:
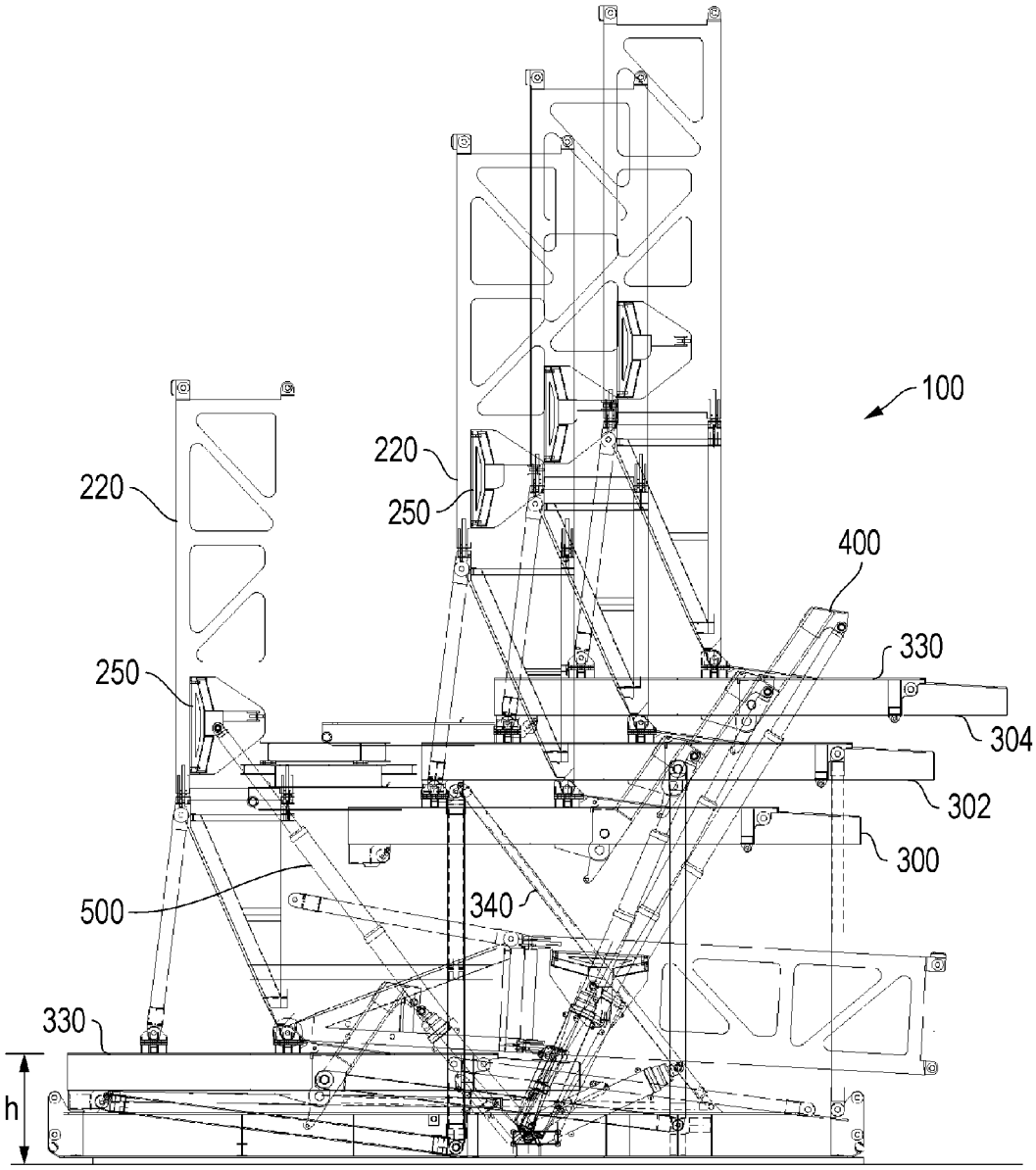
FIG. 22 is a diagram of drilling rig assemblies of three different sizes, each using the same raising cylinder pair in combination with the deployable cantilever and deployable wing bracket.

FIG. 22 is a diagram of drilling rig assemblies 100 of three different sizes, each using the same raising cylinder pair 400 in combination with the same deployable cantilever 500 and deployable wing bracket 250.

As seen in FIG. 22, the configuration of drilling rig assembly 100 of the present invention has the further benefit of enabling the use of one size of raising cylinder pair 400 in the same configuration with wing brackets 250 and cantilever 500 to raise multiple sizes of drilling rig assemblies 100. As seen in FIG. 22, a substructure 300 for a 550,000 lb. hook load drilling rig 100 is shown having a lower ground to drill floor 330 height than does substructures 302 and 304. Drilling rig designs for drilling deeper wells may encounter higher subterranean pressures, and thus require taller BOP stacks beneath drill floor 330. As illustrated, the same wing brackets 250, cantilever 500 and the raising cylinders 400 can be used with substructure 302 for a 750,000 lb. hook load drilling rig 100, or with substructure 304 for a 1,000,000 lb. hook load drilling rig 100.

As also illustrated in FIG. 22, the configuration of drilling rig assembly 100 of the present invention has a drill floor 330 height to ground of distance "h" which is less than 8 feet. This has the significant advantage of minimizing the incline and difficulty of moving mast sections 200, 210, 220 along inclined ramps 336 from the transport position into connection with front shoes 332 on top of collapse substructure 300. This is made possible by the kinematic advantages achieved by the present invention.

As described, the relationships between the several lifting elements have been shown to be extremely advantageous in limiting the required size and number of stages for raising cylinder 400, while enabling craneless rig-up of masts (200, 210, 220) and substructure 300. As further described above, the relationships between the several lifting elements have been shown to enable optimum positioning of a single pair of raising cylinders 400 to have sufficient power to raise a substructure 300, and sufficient extension and power at full extension to raise a mast (200, 210, 220) without the assistance of intermediate booster cylinder devices and reconnecting steps, and to permit such expedient mast and substructure raising for large drilling rigs.

Referring back to FIGS. 4 through 7, 9, 13 through 14, and 16 through 19, a method of assembling a drilling rig 100 is fully disclosed. The disclosure above, including the enumerated figures, provides for steps comprising: setting collapsible substructure 300 onto a drilling site; moving lower mast section 220 into proximity with substructure 300 (FIGS. 4-6); pivotally attaching lower mast section 220 to a drill floor 330 of substructure 300 (FIG. 7); pivotally deploying a pair of wing brackets 250 outward from a stowed position within lower mast section 220 to a deployed position external of lower mast section 220 (FIGS. 7 and 9); connecting articulating ends 404 of a pair of raising cylinders 400 (having opposite pivotally connected end 402 connected to substructure 300) to each wing bracket 250 (FIG. 7); extending raising cylinders 400 so as to rotate lower mast section 220 from a substantially horizontal position to an erect position above drill floor 330; pivotally deploying a pair of cantilevers 500 upward from a stowed position beneath drill floor 330 to a deployed position above drill floor 330; connecting articulating ends 404 of raising cylinders 400 to each deployed cantilever 500; and extending raising cylinders 400 so as to lift substructure 300 from a stowed, collapsed position to a deployed, erect position.

In another embodiment, shown in FIGS. 10 through 12, raising cylinders 400 are adjusted as central mast section 210 and upper mast section 200 are sequentially attached to lower mast section 220.

As will be understood by one of ordinary skill in the art, the sequence of the steps disclosed may be modified and the same advantageous result obtained. For example, the wing brackets may be deployed before connecting the lower mast section to the drill floor (or drill floor framework).

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A drilling rig assembly comprising:

a collapsible substructure movable between stowed and deployed positions, the collapsible substructure including:

a base box;

a drill floor framework;

a drill floor above the drill floor framework; and a plurality of legs having ends pivotally connected to the base box and drill floor framework, the legs supporting the drill floor above the base box in the deployed position;

a mast having a lower mast section pivotally connected above the drill floor, and movable between a generally horizontal position to a position above the drill floor;

a cantilever having a lower end and an upper end, the lower end being pivotally connected to the drill floor framework, the upper end movable between a stowed position below the drill floor and a deployed position above the drill floor;

a raising cylinder pivotally connected at one end to the base box and having an opposite articulating end;

the raising cylinder being selectively extendable relative to the pivotal connection at the base box;

the articulating end of the raising cylinder connectable to the mast such that extension of the raising cylinder moves the mast from a generally horizontal position above the drill floor to a position above the drill floor; and, the articulating end of the raising cylinder connectable to the upper end of the cantilever such that extension of the raising cylinder raises the drilling substructure into the deployed position.

2. The drilling rig according to claim 1, further comprising:

wherein the raising cylinder can be selectively connected to a lower mast section of a drilling mast that is pivotally connected above the drill floor such that extension of the raising cylinder raises the lower mast section from a generally horizontal position to a generally vertical position above the drill floor.

3. The drilling rig according to claim 1, further comprising:

a pair of retractable wing brackets pivotally attached to the lower mast section and capable of attachment to the raising cylinder; and, wherein the raising cylinder may be connected to the wing brackets and extended to rotate the lower mast section from a generally horizontal position to a generally vertical position above the drill floor.

4. The drilling rig according to claim 3, further comprising:

the wing brackets being pivotal between a deployed position and a stowed position;

a socket located on each bracket, the socket being connectable to the raising cylinder;

the wing brackets in the stowed position being contained within a width of the lower mast section; and, the wing brackets in the deployed position extend beyond the width of the lower mast such that the sockets are in alignment with the articulating end of the raising cylinder.

5. The drilling rig according to claim 1, further comprising:

a pair of wing brackets pivotally attached to the lower mast section and capable of attachment to the raising cylinder; and, wherein the raising cylinder may be connected to the wing brackets and extended to rotate the lower mast section from a generally horizontal position to a position above the drill floor that is within at least 50 degrees of vertical.

6. A drilling rig assembly comprising:

a collapsible substructure movable between stowed and deployed positions, the collapsible substructure including:

a base box;

a drill floor framework;

a drill floor above the drill floor framework; and, a plurality of legs having ends pivotally connected to the base box and drill floor framework, the legs supporting the drill floor above the base box in the deployed position;

a mast having a lower mast section pivotally connected above the drill floor, and movable between a generally horizontal position to a position above the drill floor;

a cantilever having a lower end and an upper end, the lower end being pivotally connected to the drill floor framework;

the cantilever pivotal about its lower end to move between a stowed position below the drill floor and a deployed position above the drill floor;

a raising cylinder pivotally connected at one end to the base box and having an opposite articulating end;

the raising cylinder being selectively extendable relative to the pivotal connection at the base box;

the articulating end of the raising cylinder connectable to the mast such that extension of the raising cylinder moves the mast from a generally horizontal position above the drill floor to a position above the drill floor; and, the articulating end of the raising cylinder connectable to the upper end of the cantilever such that extension of the raising cylinder raises the drilling substructure into the deployed position.

7. A drilling rig assembly comprising:

a collapsible substructure movable between stowed and deployed positions, the collapsible substructure including:

a base box;

a drill floor framework;

a drill floor above the drill floor framework; and, a plurality of legs having ends pivotally connected to the base box and drill floor framework, the legs supporting the drill floor above the base box in the deployed position;

a mast having a lower mast section pivotally connected above the drill floor, and movable between a generally horizontal position to a position above the drill floor;

a cantilever having a lower end and an upper end, the lower end being pivotally connected to the drill floor framework, the upper end movable between a stowed position below the drill floor and a deployed position above the drill floor;

a raising cylinder pivotally connected at one end to the base box and having an opposite articulating end;

the raising cylinder being selectively extendable relative to the pivotal connection at the base box;

the articulating end of the raising cylinder connectable to the mast such that extension of the raising cylinder moves the mast from a generally horizontal position above the drill floor to a position above the drill floor; and, the articulating end of the raising cylinder connectable to the upper end of the cantilever such that extension of the raising cylinder raises the drilling substructure into the deployed position without imparting the lifting force to the mast.

8. A drilling rig assembly comprising:

a collapsible substructure movable between stowed and deployed positions, the collapsible substructure including:

a base box;

a drill floor framework;

a drill floor above the drill floor framework; and, a plurality of legs having ends pivotally connected to the base box and drill floor framework, the legs supporting the drill floor above the base box in the deployed position;

a mast having a lower mast section pivotally connected above the drill floor, and movable between a generally horizontal position to a position above the drill floor;

a cantilever having a lower end and an upper end, the lower end being pivotally connected to the drill floor framework, the upper end movable between a stowed position below the drill floor and a deployed position above the drill floor when the mast is the position above the drill floor;

a raising cylinder pivotally connected at one end to the base box and having an opposite articulating end;

the raising cylinder being selectively extendable relative to the pivotal connection at the base box;

the articulating end of the raising cylinder connectable to the mast such that extension of the raising cylinder moves the mast from a generally horizontal position above the drill floor to a position above the drill floor; and, the articulating end of the raising cylinder connectable to the upper end of the cantilever such that extension of the raising cylinder raises the drilling substructure into the deployed position.

9. A drilling rig assembly comprising:

a collapsible substructure movable between stowed and deployed positions, the collapsible substructure including:

a base box;

a drill floor framework;

a drill floor above the drill floor framework; and, a plurality of legs having ends pivotally connected to the base box and drill floor framework, the legs supporting the drill floor above the base box in the deployed position;

a mast having a lower mast section pivotally connected above the drill floor, and movable between a generally horizontal position to a position above the drill floor;

a cantilever having a lower end and an upper end, the lower end being pivotally connected to the drill floor framework, the upper end movable between a stowed position below the drill floor and a deployed position above the drill floor, while the lower end remains below the drill floor;

a raising cylinder pivotally connected at one end to the base box and having an opposite articulating end;

the raising cylinder being selectively extendable relative to the pivotal connection at the base box;

the articulating end of the raising cylinder connectable to the mast such that extension of the raising cylinder moves the mast from a generally horizontal position above the drill floor to a position above the drill floor; and, the articulating end of the raising cylinder connectable to the upper end of the cantilever such that extension of the raising cylinder raises the drilling substructure into the deployed position.

* * * * *